US007845296B1

(12) United States Patent
Khachaturian

(10) Patent No.: US 7,845,296 B1
(45) Date of Patent: Dec. 7, 2010

(54) MARINE LIFTING APPARATUS

(76) Inventor: Jon Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 12/261,425

(22) Filed: Oct. 30, 2008

Related U.S. Application Data

(63) Continuation-in-part of application No. 11/610,271, filed on Dec. 13, 2006, now Pat. No. 7,527,006.

(51) Int. Cl.
*B63C 7/02* (2006.01)

(52) U.S. Cl. ..... 114/50

(58) Field of Classification Search ..... 114/50, 114/51, 53, 61.1, 61.15, 61.16; 403/57, 61, 403/62, 74

See application file for complete search history.

(56) References Cited

U.S. PATENT DOCUMENTS

| | | | | |
|---|---|---|---|---|
| 485,398 | A * | 11/1892 | Tyler et al. | 114/51 |
| 4,714,382 | A | 12/1987 | Khachaturian | |
| 5,607,260 | A | 3/1997 | Khachaturian | |
| 5,609,441 | A | 3/1997 | Khachaturian | |
| 5,662,434 | A | 9/1997 | Khachaturian | |
| 5,800,093 | A | 9/1998 | Khachaturian | |
| 5,836,463 | A | 11/1998 | Khachaturian | |
| 5,863,085 | A | 1/1999 | Khachaturian | |
| 5,975,807 | A | 11/1999 | Khachaturian | |
| 6,000,562 | A | 12/1999 | Khachaturian | |
| 6,039,506 | A | 3/2000 | Khachaturian | |
| 6,079,760 | A | 6/2000 | Khachaturian | |
| 6,149,350 | A | 11/2000 | Khachaturian | |
| 6,213,319 | B1 | 4/2001 | Khachaturian | |
| 6,296,288 | B1 | 10/2001 | Khachaturian | |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 6,412,649 | B1 | 7/2002 | Khachaturian | |

(Continued)

*Primary Examiner*—Ed Swinehart
(74) *Attorney, Agent, or Firm*—Garvey, Smith, Nehrbass & North, L.L.C.; Charles C. Garvey, Jr.

(57) ABSTRACT

A catamaran lifting apparatus is disclosed for lifting objects in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. The catamaran hull arrangement provides longitudinal flexibility in a quartering sea state due to the unique universal joint and hinge placement between the frames or trusses and the hulls or barges. Each of the frames extends upwardly in an inverted u-shape, providing a space under the frame and in between the barges that enables a marine vessel to be positioned in between the barges and under the frames. In this fashion, an object that has been salvaged from the seabed can be placed upon the marine vessel that is positioned in between the barges and under the frames. Alternatively, a package that is to be lifted from the deck of a marine vessel, workboat, supply boat or the like can be lifted from the deck of the workboat, vessel, barge, etc. if it is to be then placed in the marine environment such as upon an existing jacket or other under support.

33 Claims, 24 Drawing Sheets

U.S. PATENT DOCUMENTS

| | | | |
|---|---|---|---|
| 6,425,710 | B1 | 7/2002 | Khachaturian |
| 6,435,773 | B1 | 8/2002 | Khachaturian |
| 6,435,774 | B1 | 8/2002 | Khachaturian |
| 6,601,717 | B1 | 8/2003 | Khachaturian |
| 6,692,190 | B2 | 2/2004 | Khachaturian |
| 6,719,495 | B2 | 4/2004 | Khachaturian |
| 7,066,343 | B1 | 6/2006 | Khachaturian |
| 7,399,018 | B1 | 7/2008 | Khachaturian |

* cited by examiner

MARINE LIFTING APPARATUS

CROSS-REFERENCE TO RELATED APPLICATIONS

This is a continuation-in-part of U.S. Ser. No. 11/610,271, filed Dec. 13, 2006.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to an improved catamaran type lifting apparatus that employs spaced apart or catamaran hulls, each of the hulls supporting a truss or frame that spans between the hulls at spaced apart positions. Even more particularly, the present invention relates to an improved catamaran lifting apparatus for use in a marine environment, wherein spaced apart frames are connected to the hulls in a configuration that spaces the vessels apart, the first frame connecting with a first of the hulls with the universal joint and to the second hull with a hinged connection, the second frame connecting to the second hull with a universal joint and to the first hull with a hinged connection.

2. General Background

A catamaran lifting apparatus that can be used to lift multi-ton objects employs two spaced apart barges or hulls or vessels. In general, such lifting devices that employ a pair of spaced apart hulls have been patented, many patents having been issued to applicant as contained in the following table.

TABLE 1

| PAT. NO. | TITLE | ISSUE DATE |
|---|---|---|
| 4,714,382 | Method and Apparatus for the Offshore Installation of Multi-Ton Prefabricated Deck Packages on Partially Submerged Offshore Jacket Foundations | Dec. 22, 1987 |
| 5,607,260 | Method and Apparatus for the Offshore Installation of Multi-Ton Prefabricated Deck Packages on Partially Submerged Offshore Jacket Foundations | Mar. 1, 1997 |
| 5,609,441 | Method and Apparatus for the Offshore Installation of Multi-Ton Prefabricated Deck Packages on Partially Submerged Offshore Jacket Foundations | Mar. 11, 1997 |
| 5,662,434 | Method and Apparatus for the Offshore Installation of Multi-Ton Prefabricated Deck Packages on Partially Submerged Offshore Jacket Foundations | Sep. 2, 1997 |
| 5,800,093 | Method and Apparatus for the Offshore Installation of Multi-Ton Packages Such as Deck Packages, Jackets, and Sunken Vessels | Sep. 1, 1998 |
| 5,975,807 | Method and Apparatus for the Offshore Installation of Multi-Ton Packages Such as Deck Packages and Jackets | Nov. 2, 1999 |
| 6,039,506 | Method and Apparatus for the Offshore Installation of Multi-Ton Packages Such as Deck Packages and Jackets | Mar. 21, 2000 |
| 6,149,350 | Method and Apparatus for the Offshore Installation of Multi-Ton Packages Such as Deck Packages and Jackets | Nov. 21, 2000 |

TABLE 1-continued

| PAT. NO. | TITLE | ISSUE DATE |
|---|---|---|
| 6,318,931 | Method and Apparatus for the Offshore Installation of Multi-Ton Packages Such as Deck Packages and Jackets | Nov. 20, 2001 |
| 6,364,574 | Method and Apparatus for the Offshore Installation of Multi-Ton Packages Such as Deck Packages and Jackets | Apr. 2, 2002 |

BRIEF SUMMARY OF THE INVENTION

The present invention provides an improved catamaran lifting apparatus that employs first and second spaced apart vessels or hulls. The vessels can be barges, dynamically positioned marine vessels, other floating hulls or the like.

A first frame or truss spans between the vessels or hulls at a first position. A second frame or truss spans between the hulls at a second position. The first and second positions are spaced apart so that each frame can move independently of the other, notwithstanding wave action acting upon the hulls. Load spreaders can provide an interface between each frame or truss and each vessel (e.g. barge, ship, etc.)

The first of the frames or trusses connects to the first hull or vessel with a universal joint and to the second hull or vessel with a hinged connection. The second frame connects to the second hull with a universal joint and to the first hull with a hinged connection.

The catamaran hull arrangement of the present invention provides longitudinal flexibility in a quartering sea state due to the unique universal joint and hinge placement between the frames or trusses and the hulls or vessels.

Each frame extends upwardly in a generally inverted u-shape that provides space under each frame or truss and in between the vessels or hulls for enabling a marine vessel to be positioned in between the hulls and under the frames. The space in between the hulls or vessels and under the frames or trusses can also be used as clearance for elevating an object to be salvaged from the seabed to a position next to or above the water's surface.

In a plan view, each frame or truss can be generally triangular in shape. Winches and rigging such as a block and tackle arrangement can be used to lift objects with the apparatus of the present invention. The frames can each be of a truss configuration.

In a second embodiment, one or more slings can be provided that connect between a frame and a hull. The connection of each frame to a hull opposite the universal joint can be a pinned or a hinged connection.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 9A-9D are fragmentary views of the preferred embodiment of the apparatus of the present invention, wherein FIG. 9B is a sectional, top view taken along lines 9B-9B of FIG. 9A, FIG. 9C is an elevation view taken along lines 9C-9C of FIG. 9A, and FIG. 9D is a sectional view taken along lines 9D-9D of FIG. 9C;

DETAILED DESCRIPTION OF THE INVENTION

Figure 1:
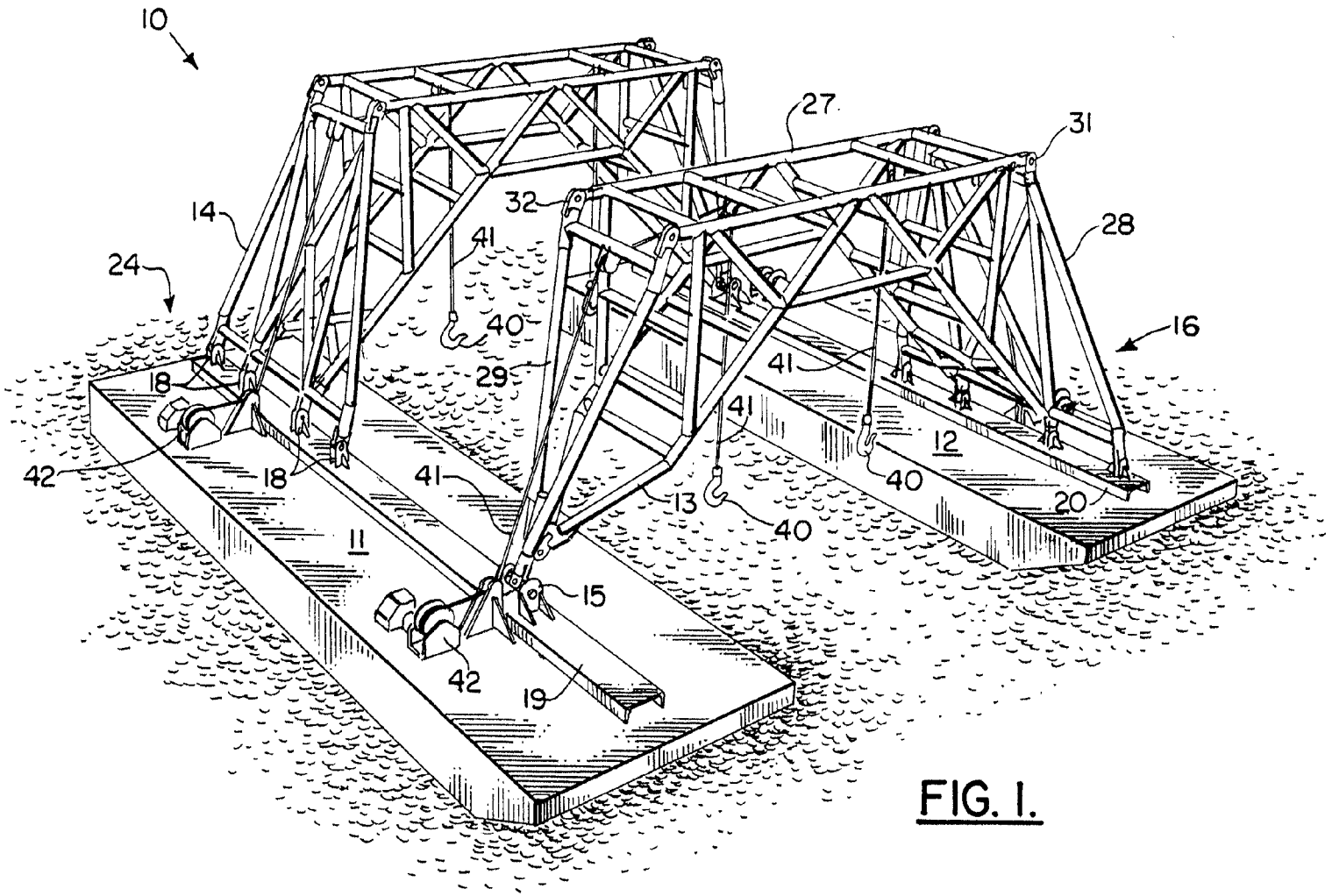
FIG. 1 is a perspective view of the preferred embodiment of the apparatus of the present invention.
Figure 2:
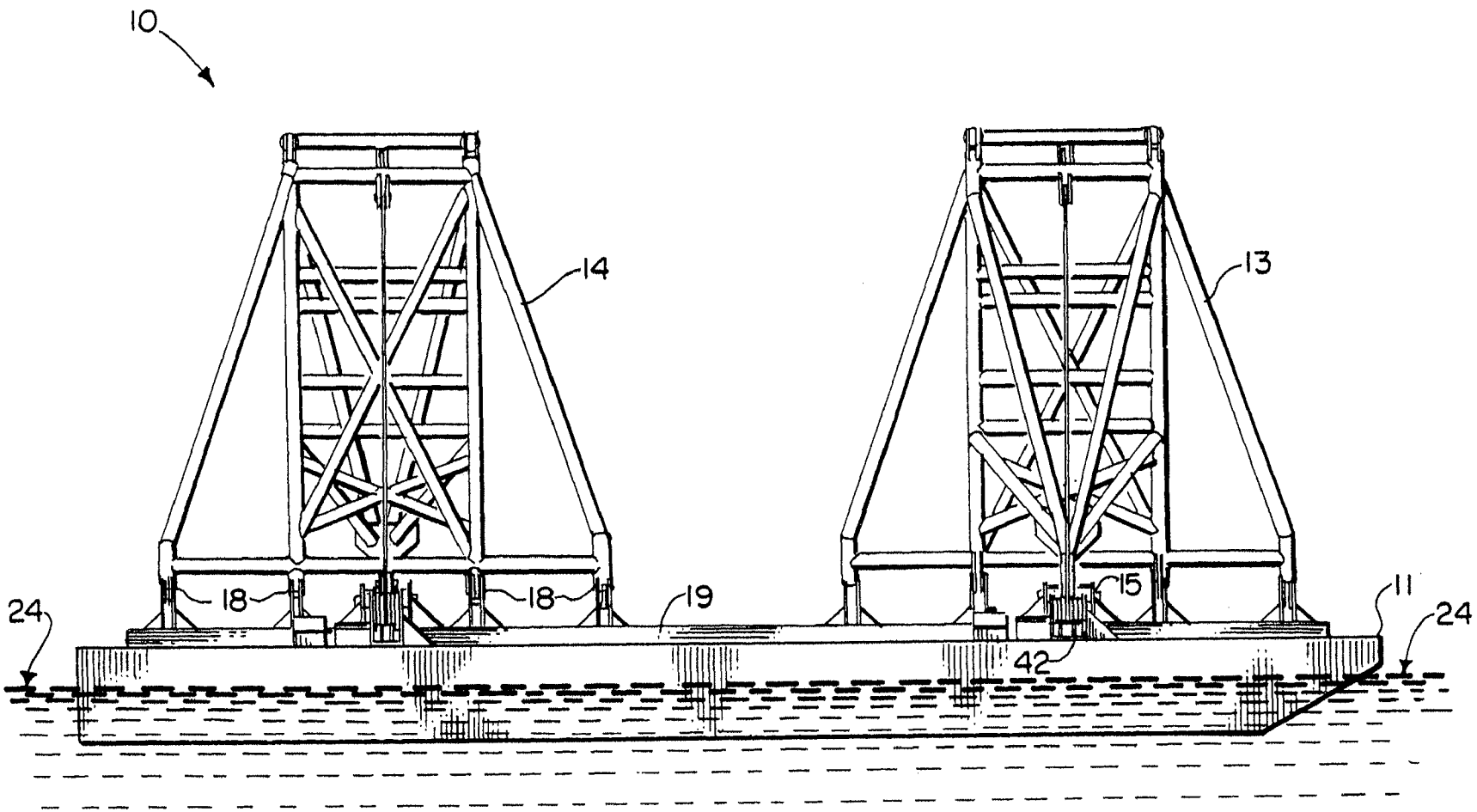
FIG. 2 is a side, elevation view of the preferred embodiment of the apparatus of the present invention.

FIGS. 1-7 and 9-11 show the preferred embodiment of the apparatus of the present invention designated generally by the numeral 10. Marine lifting apparatus 10 provides a pair of spaced apart vessels or hulls 11, 12, each providing a deck 30. Hulls 11, 12 can be barges, dynamically positioned vessels, or any other buoyant structure. A pair of frames or trusses 13, 14 are provided, each frame 13, 14 spanning between the vessels 11, 12. Each frame 13, 14 connects to one vessel 11 or 12 with a universal joint 15 or 17 (see FIGS. 1, 4, 9) and to the other hull 11 or 12 with a hinged or pinned connection 16 or 18 (see FIGS. 4-12).

The first frame 13 connects to hull 11 with universal joint 15 (or articulating connection). The first frame 13 connects to vessel 12 with a pinned connection or hinge 16. Similarly, the second frame 14 connects to hull 12 with a universal joint 17 (or articulating connection) and to hull 11 with a hinge or pinned connection 18 (see FIG. 4).

An interface such as a deck beam or load spreader platform 19 or 20 can be provided on the upper deck 30 of each hull 11, 12 for forming an interface between the frames 13, 14 and the vessels 11, 12. For example, vessel 11 is provided with deck beam or load spreader platform 19 on its deck 30 that forms an interface between each of the frames 13, 14 and the barge or vessel 11 deck 30. Deck beam or load spreader platform 20 provides an interface between each of the frames 13, 14 and deck 30 of the vessel or barge 12.

Figure 4:
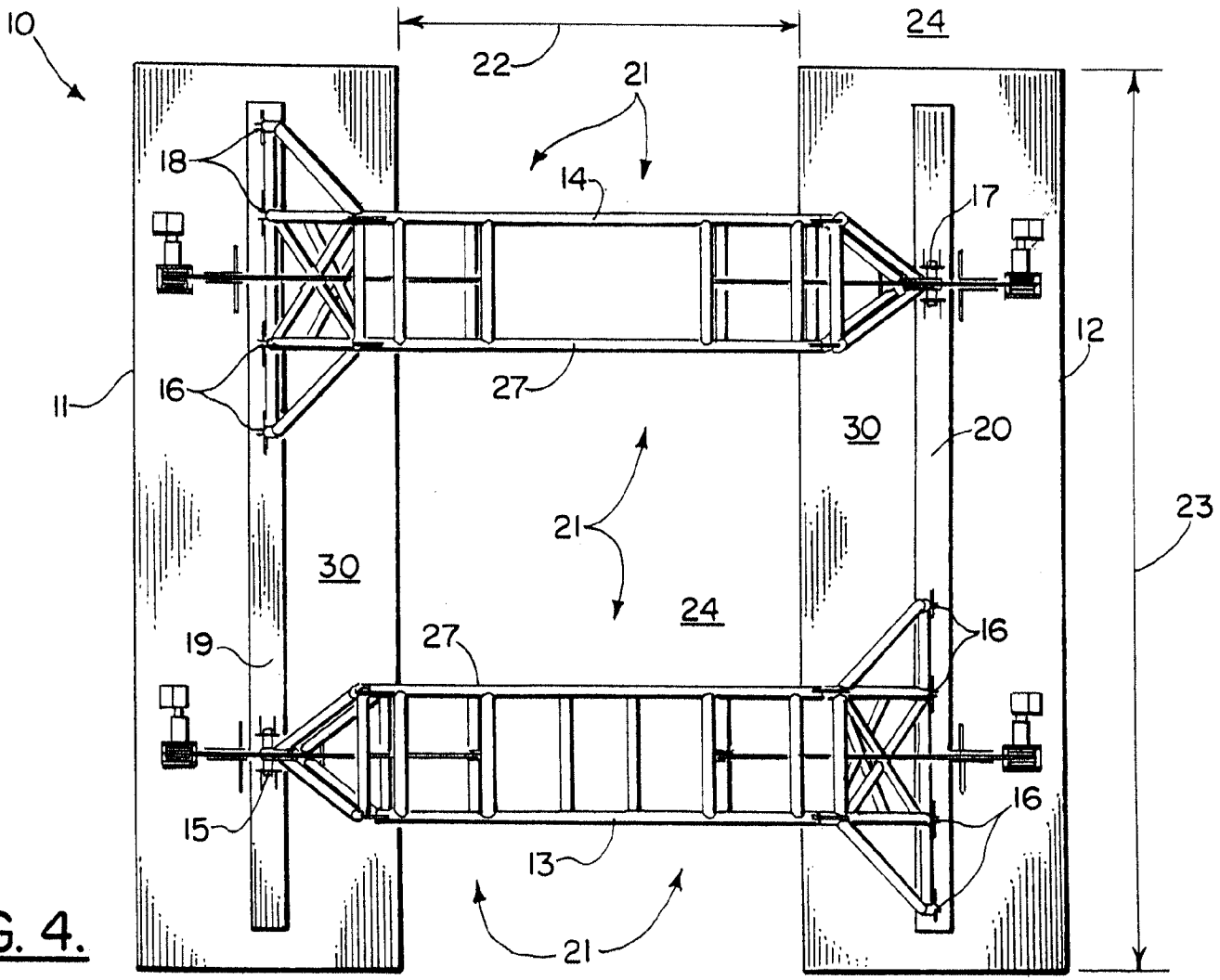
FIG. 4 is a top plan view of the preferred embodiment of the apparatus of the present invention.
Figure 5:
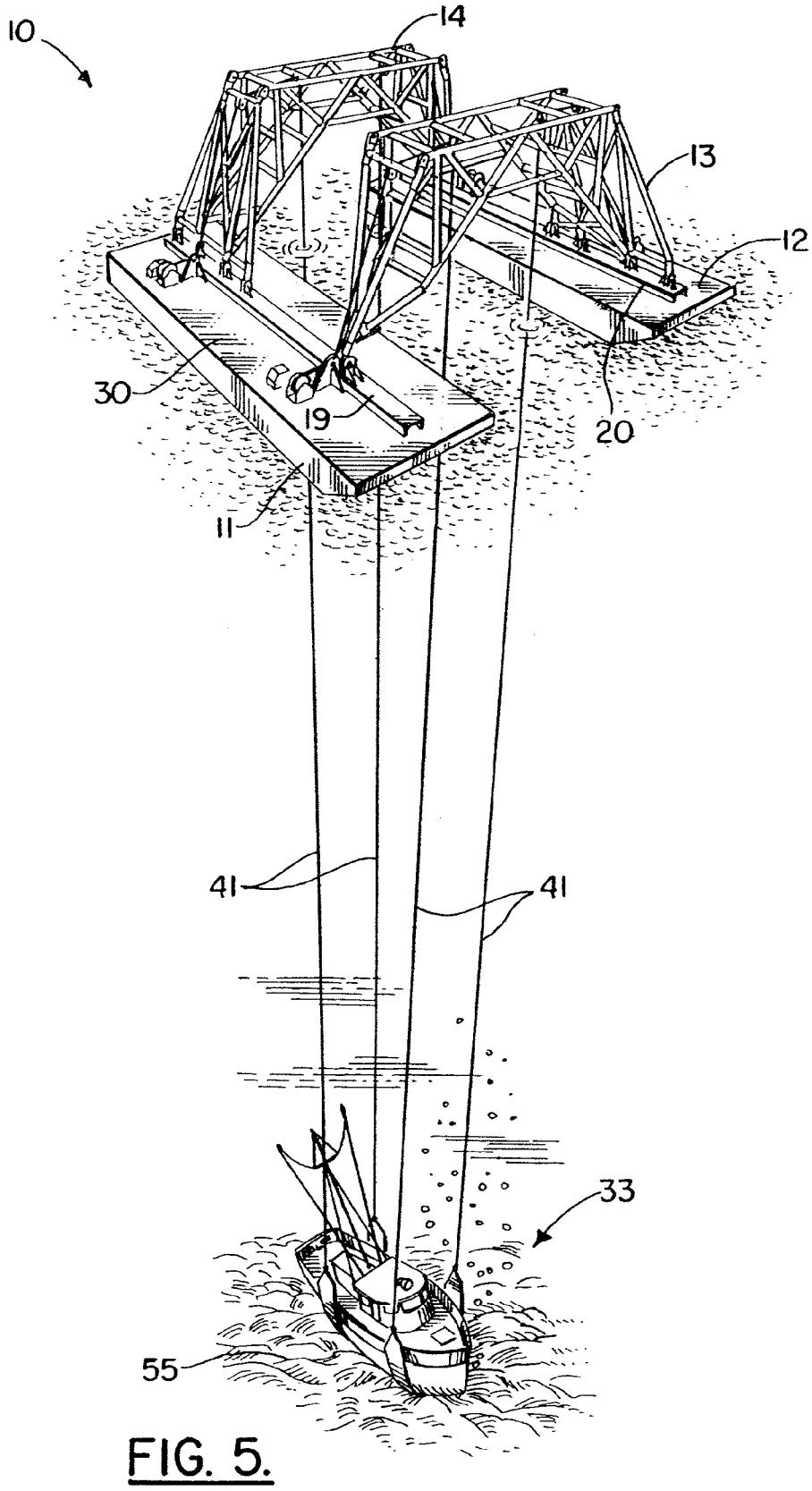
FIG. 5 is a perspective view of the preferred embodiment of the apparatus of the present invention.

In FIG. 4, a plan or top view of the apparatus 10 of the present invention is shown. A lifting area 21 is that area that is in between the vessels 11, 12, the area 21 having a length defined by dimension arrow 23 and a width defined by dimension arrow 22 in FIG. 4. This area 21 is sized and shaped to receive a vessel having a cargo to be lifted if that cargo (e.g. deck package) is to be installed. Alternatively, the area 21 can be an area that receives a vessel for supporting and transporting an item to be salvaged from an ocean floor (see FIGS. 5 and 11-15) such as a hurricane smashed or damaged offshore platform section 34, sunken boat 33 or the like. In either case, a clearance is provided above the water surface 24.

Figure 3:
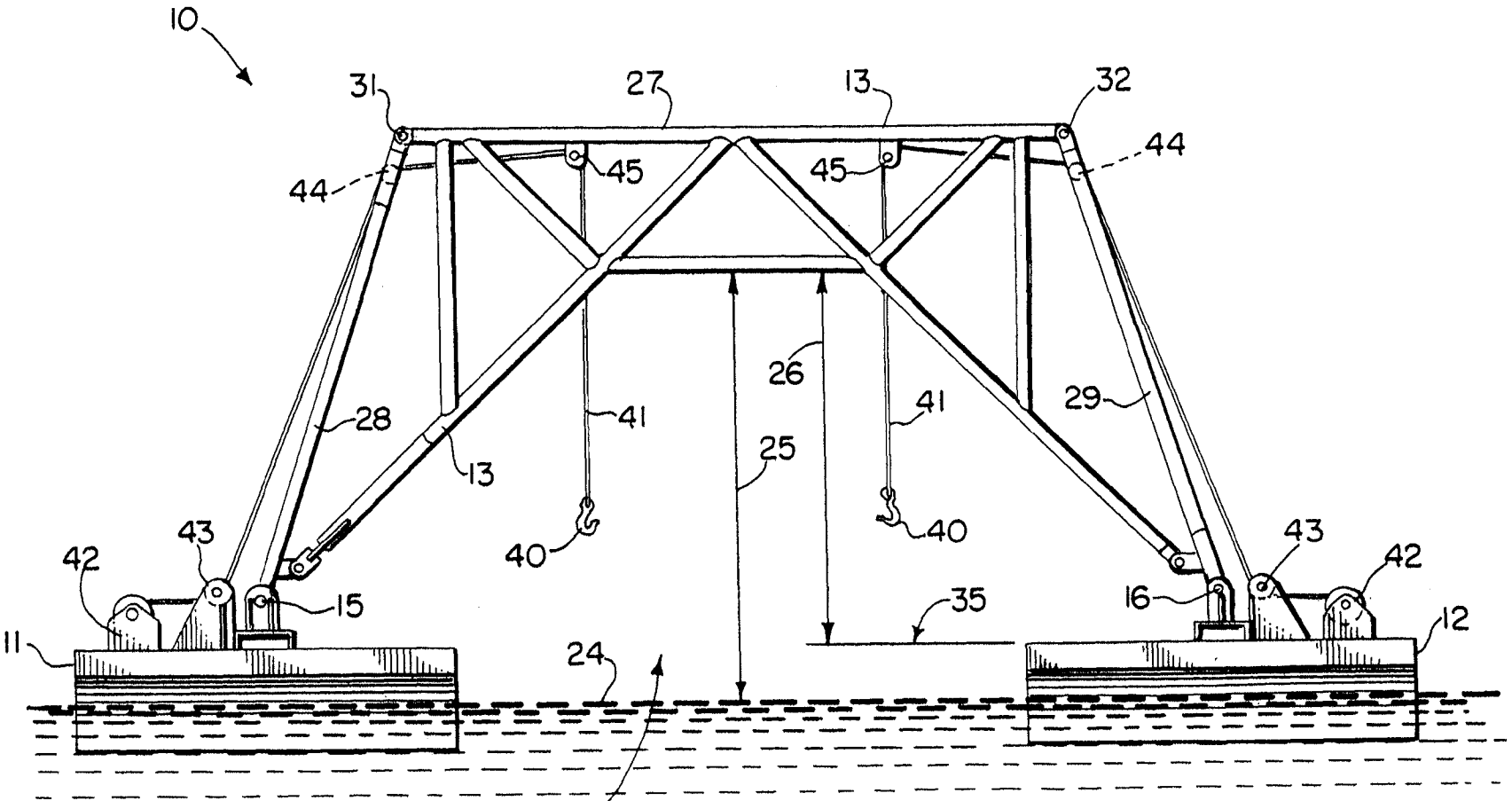
FIG. 3 is an end elevation view of the preferred embodiment of the apparatus of the present invention, with each winch and lifting line removed for clarity.

In FIG. 3, a clearance between water surface 24 and frame 13 or 14 is indicated schematically by the dimension line 25. Similarly, a clearance 26 is provided above the maximum deck elevation 35 of the hulls 11, 12 as shown in FIG. 3.

Each of the frames 13, 14 can be in the form of a truss as shown. The frames are generally speaking in the shape of an arch or inverted U so that an area is provided under the frames and above the water surface for raising an item that is being salvaged or to lift an item from a barge or other vessel or support that is under the frames. Each truss or frame 13, 14 can be a one piece structure (see FIG. 10) or a multi-section truss (see FIGS. 1-4). For multi-section frames 13, 14 they provide a center truss section 27, a smaller side truss section 28 and another smaller side truss section 29. Pinned connections 31, 32 can be provided for attaching the smaller truss sections 28, 29 to the larger center truss section 27 as shown in FIGS. 3 and 4.

Slings can optionally be provided for connecting the center section 27 to the lower end portion of each of the smaller truss sections 28, 29. Shackles can be used to attach each of the slings to eyelets or padeyes on the center section 27. Likewise, shackles can be used to attach the slings to eyelets or padeyes on the smaller truss sections 28, 29.

Figure 13:
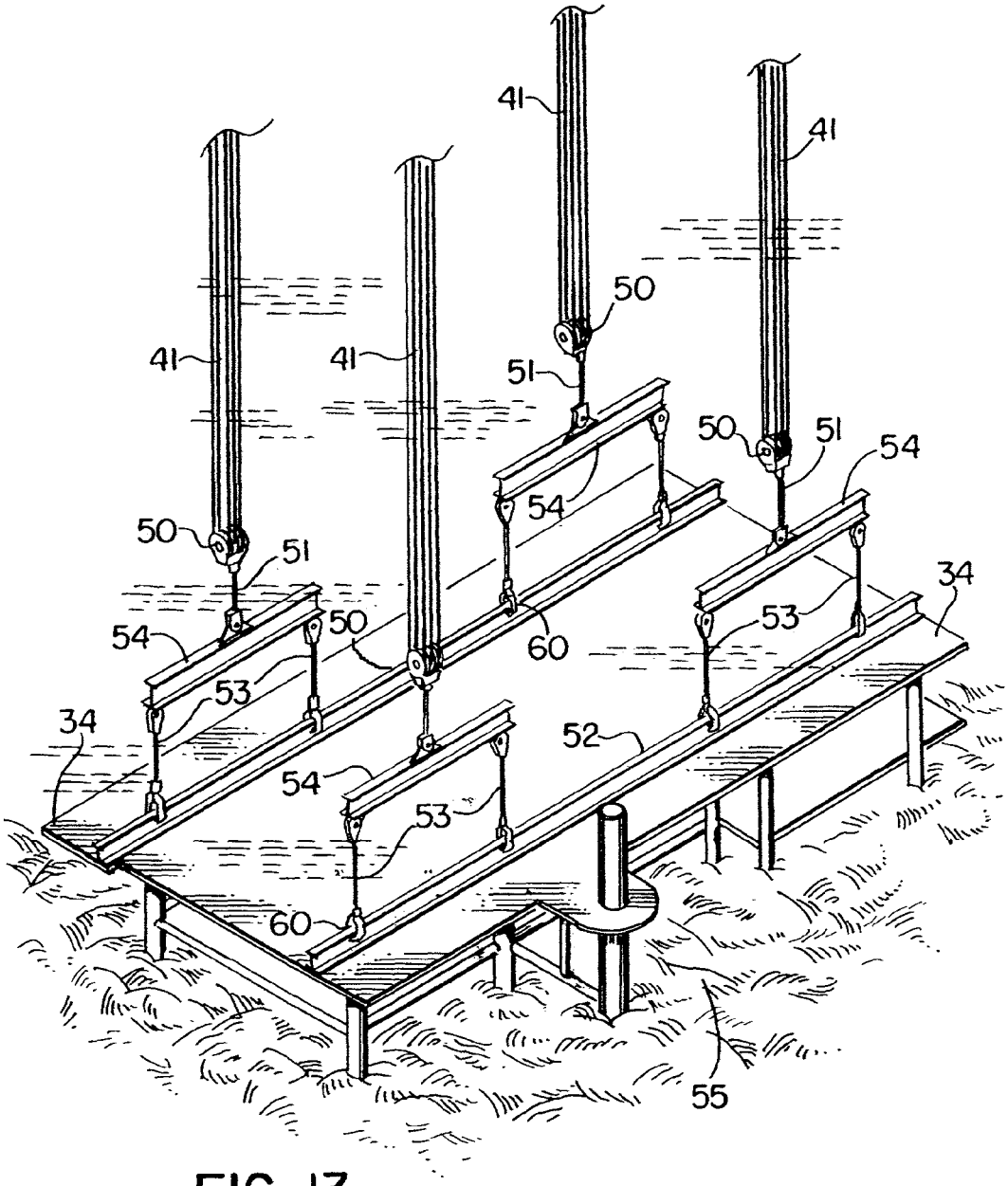
FIG. 13 is a partial perspective view of the preferred embodiment of the apparatus of the present invention and showing a method step of the present invention.

A hook 40 or other lifting fitting can be attached to a lifting line 41 and payed out from winch 42. More than one lifting line 41 and hook 40 can be provided as shown. Sheaves 43, 44, 45 as needed can be used to route the line 41 from winch 42 to hook 40. Line 41 can be a multiple line assembly to increase lift capacity such as is shown in FIG. 13. Hook 40 can be any lifting fitting such as any known commercially available crown block, for example.

Figure 6:
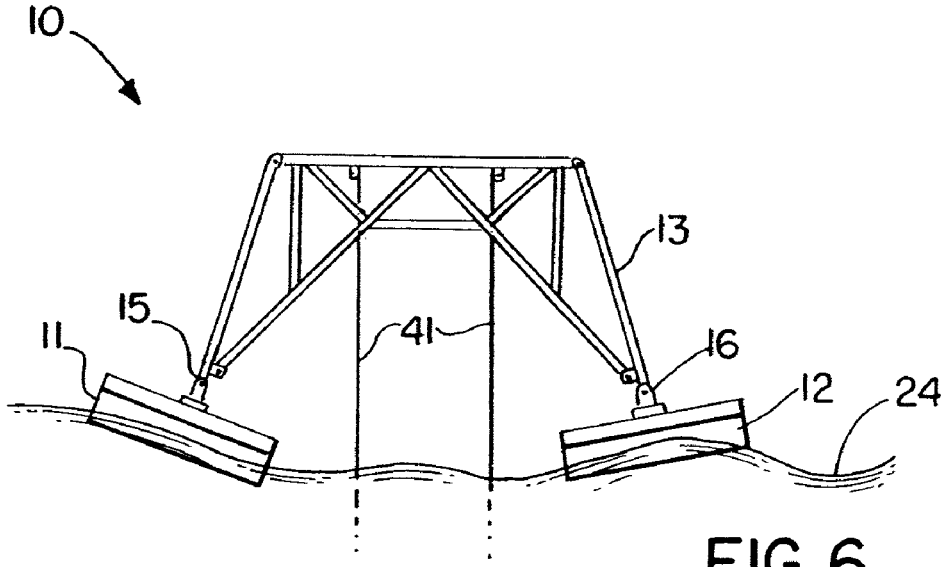
FIGS. 6-8 are schematic illustrations of a rough sea condition.
Figure 7:
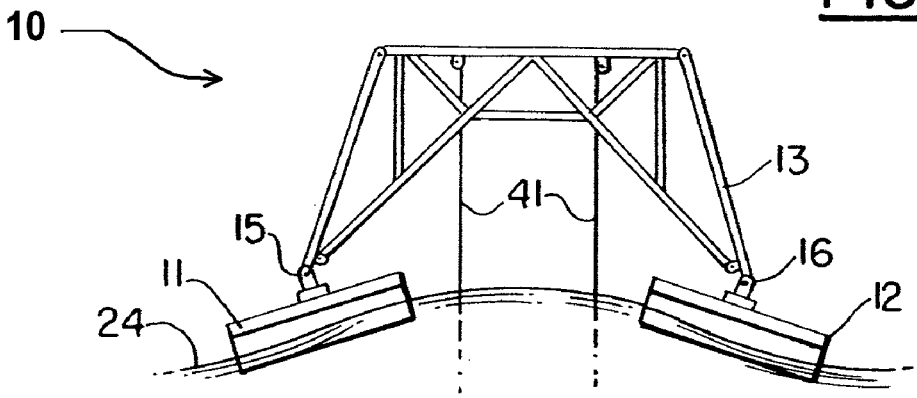
Figure 8:
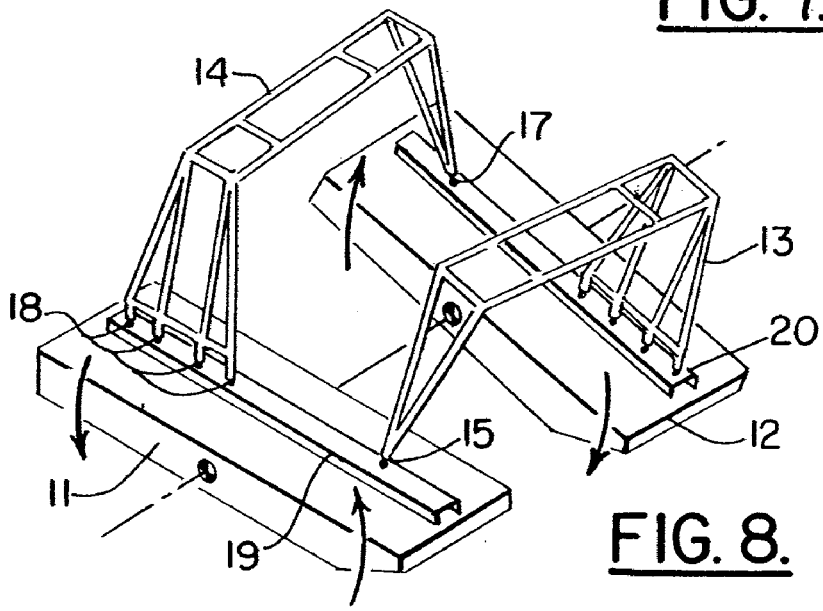
Figure 9A:
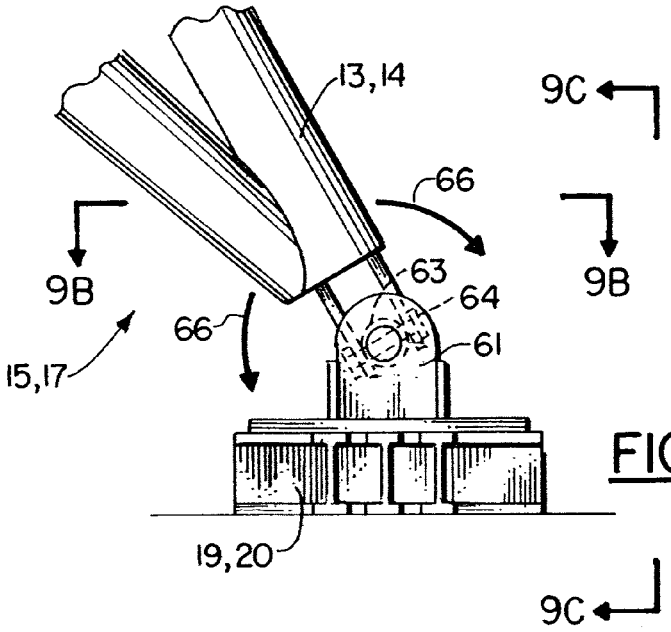
Figure 9B:
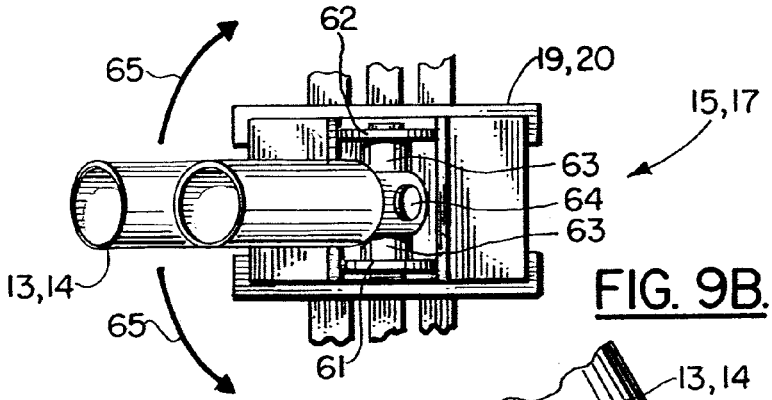
Figure 9C:
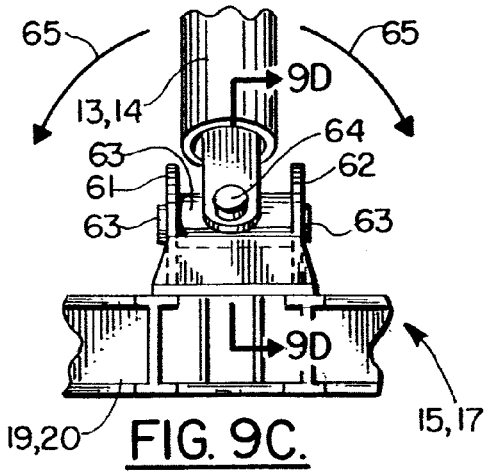
Figure 9D:
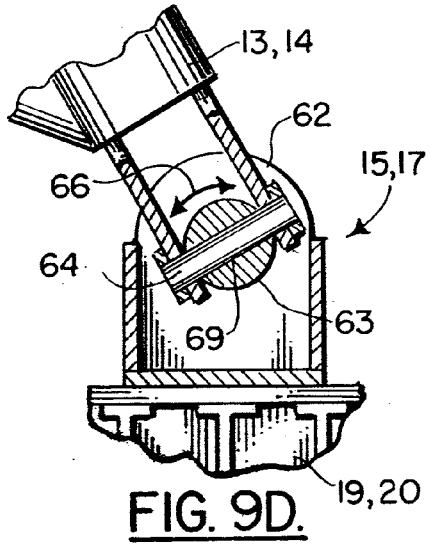

FIGS. 6-9 illustrate the articulation that is achieved with the method and apparatus of the present invention, even in rough seas. In FIGS. 6 and 7, rough sea conditions are shown wherein the vessels 11, 12 assume differing orientations relative to each other caused by the rough sea state. Notwithstanding the orientation of the vessels 11, 12 the combination of an articulating connection 15, 17 with hinged or pinned connections 16, 18 enables complete articulation between each of the frames or trusses 13, 14 and each of the vessels or hulls 11, 12.

In FIGS. 9A-9D, an exemplary articulating connection 15, 17 is shown. In FIGS. 9A-9D, a frame or truss 13, 14 connects to a load spreader platform 19 or 20 at padeyes 61, 62. A first shaft 63 is pivotally attached to the padeyes 61, 62. A second shaft 64 is pivotally attached to the first shaft 63 at opening 69 in first shaft 63. The second shaft 64 also defines a pivotal connection for the frame 13 or 14 to the first shaft 63 as shown. This universal joint arrangement enables the frame 13 (or 14) to move in an articulating fashion with respect to the load spreader platform 19 or 20 and with respect to the underlying vessel 11 or 12 as indicated schematically by arrows 65, 66 in FIG. 9.

FIGS. 10-17 show the preferred embodiment of the apparatus of the present invention when fitted with a block and tackle arrangement. Vessels 11, 12 are also shown fitted with anchor lines 67 that connect conventional anchors (not shown) to anchor winches 68 on the vessels 11, 12. The anchor winches 68 can be used to exactly position vessels 11, 12 and to stabilize their positions during a lift. A block and tackle arrangement (FIGS. 10-17) can be used to lift an item to be salvaged from the seabed 55 such as the damaged platform section 34 in FIG. 11.

Figure 10:
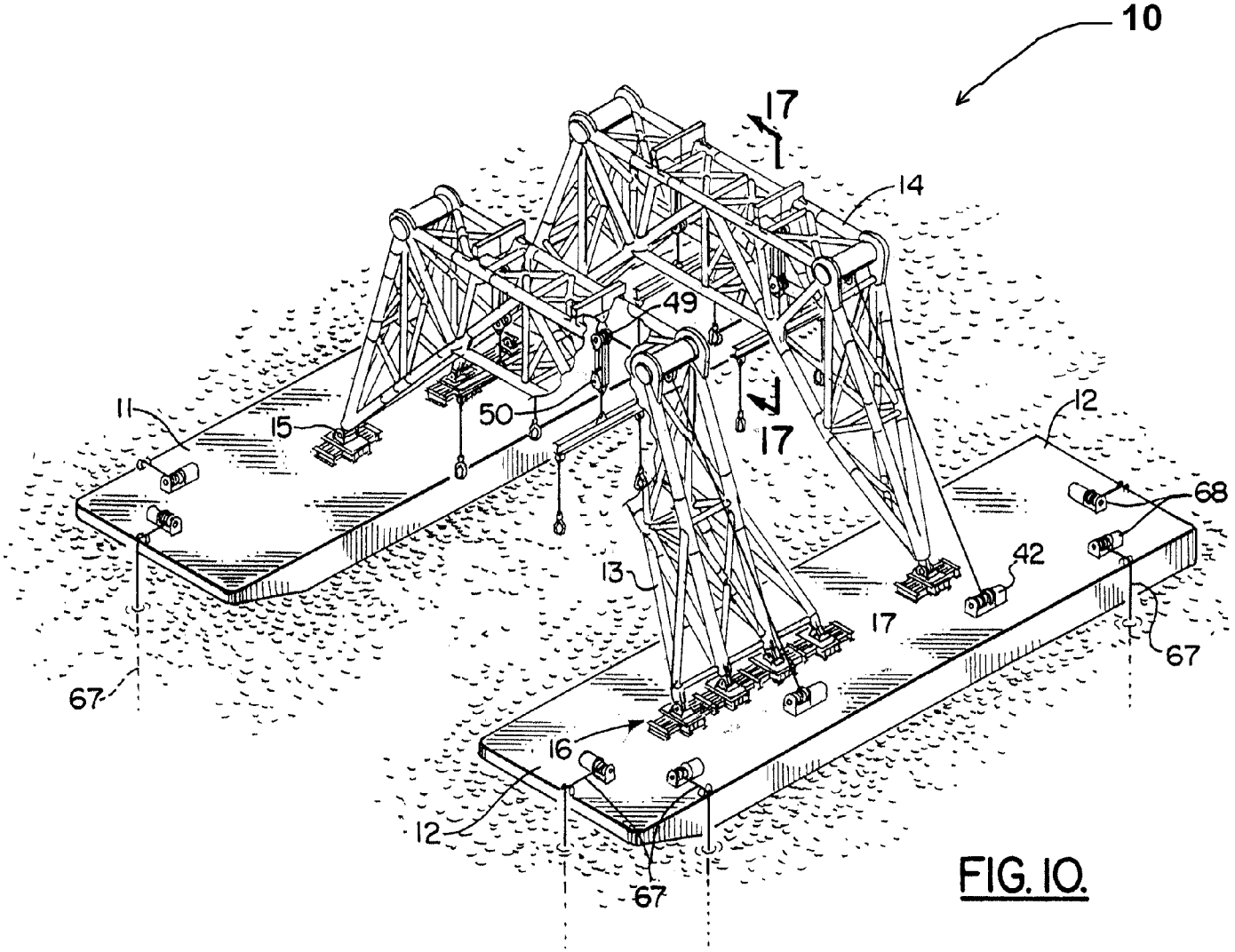
FIG. 10 is a perspective view of the preferred embodiment of the apparatus of the present invention showing a block and tackle rigging with winches and lift lines.
Figure 11:
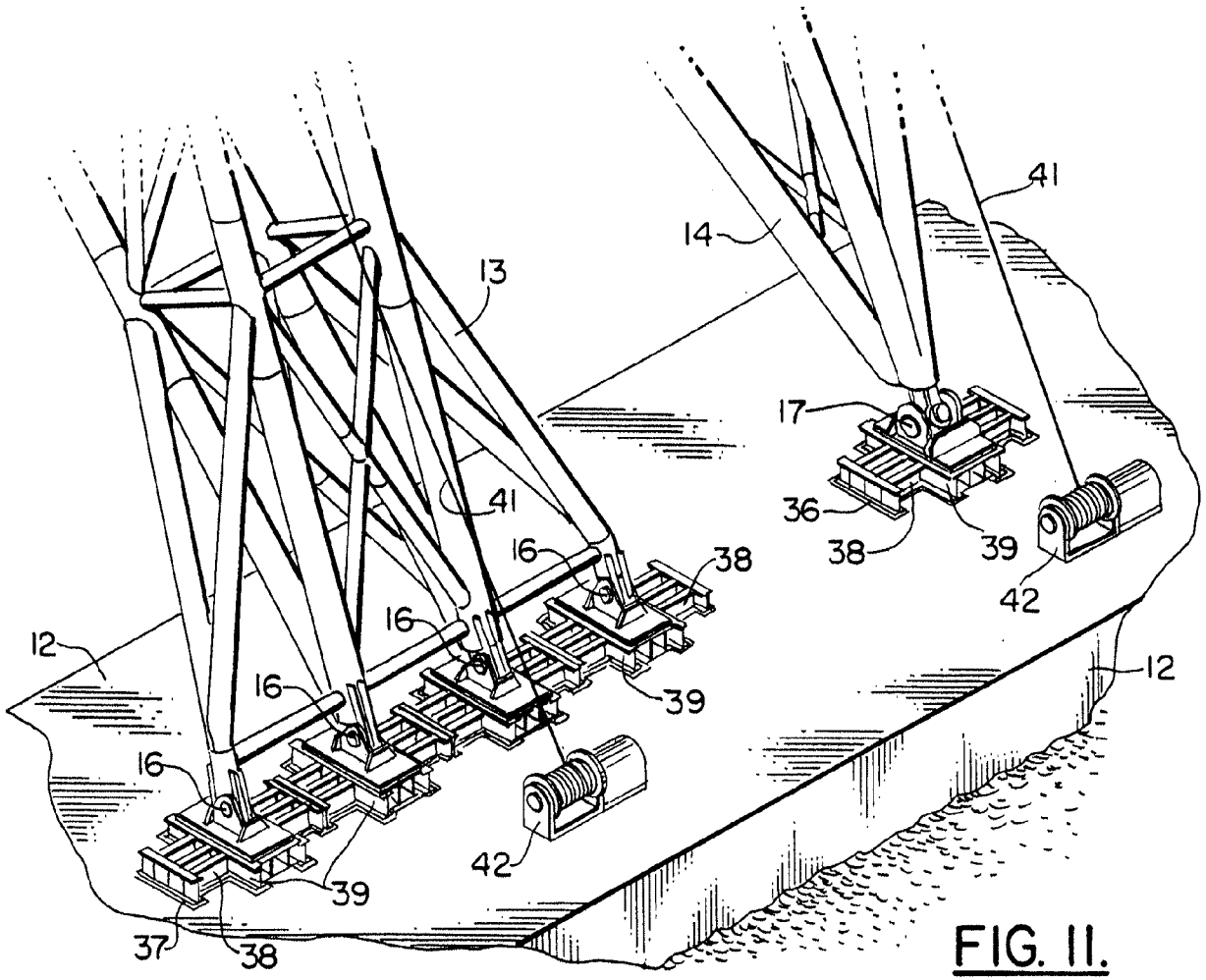
FIG. 11 is a fragmentary perspective view of the preferred embodiment of the apparatus of the present invention.
Figure 12:
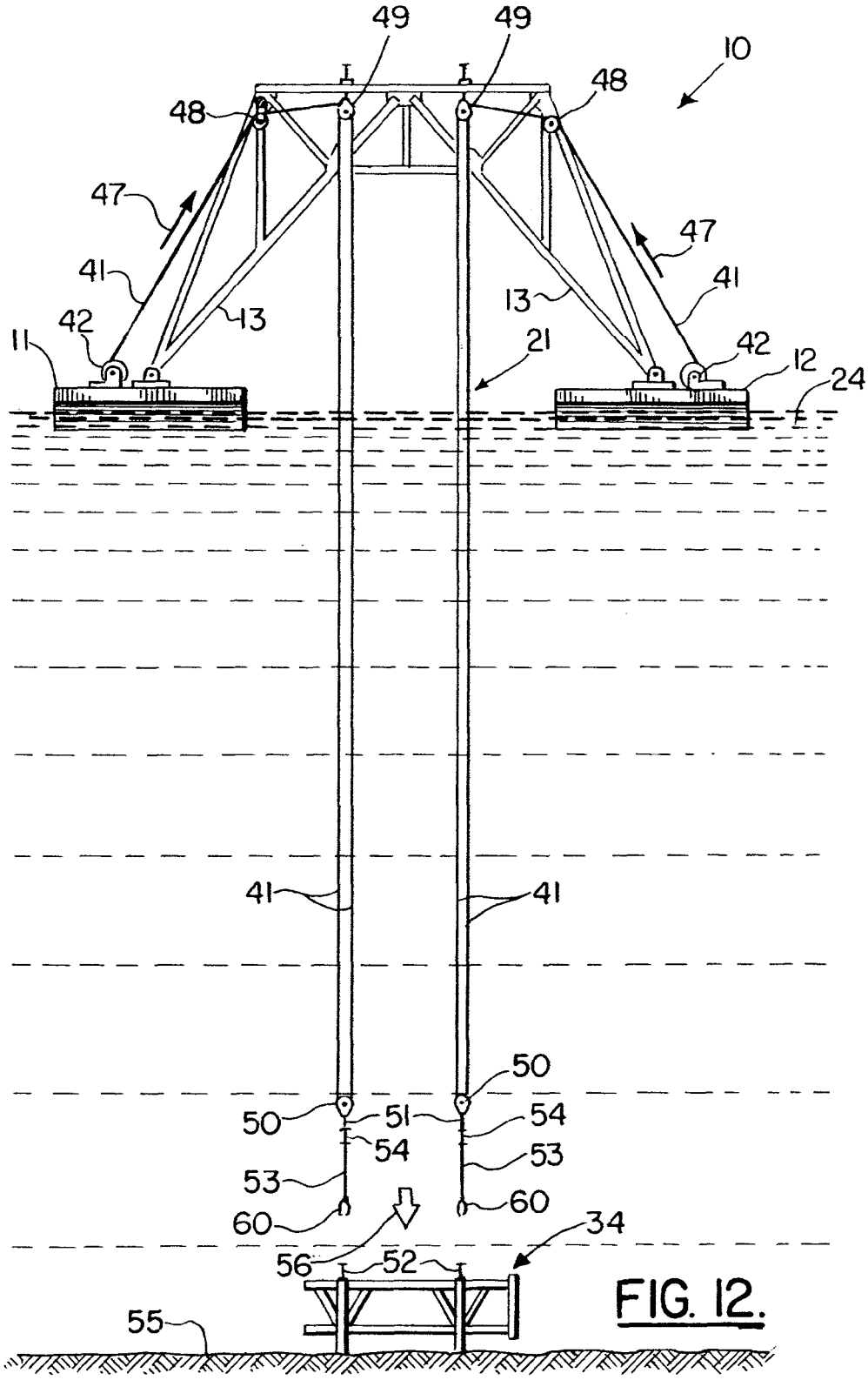
FIG. 12 is an elevation view of the preferred embodiment of the apparatus of the present invention and showing a method step of the present invention.
Figure 15:
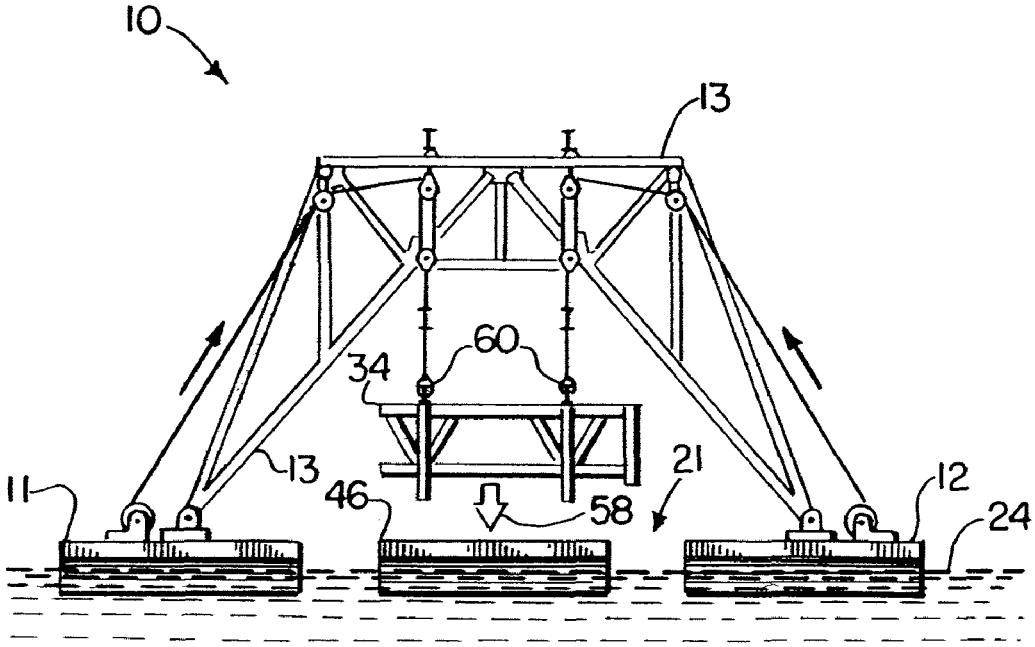
FIGS. 15-16 are elevation views that further illustrate the method of the present invention.
Figure 16:
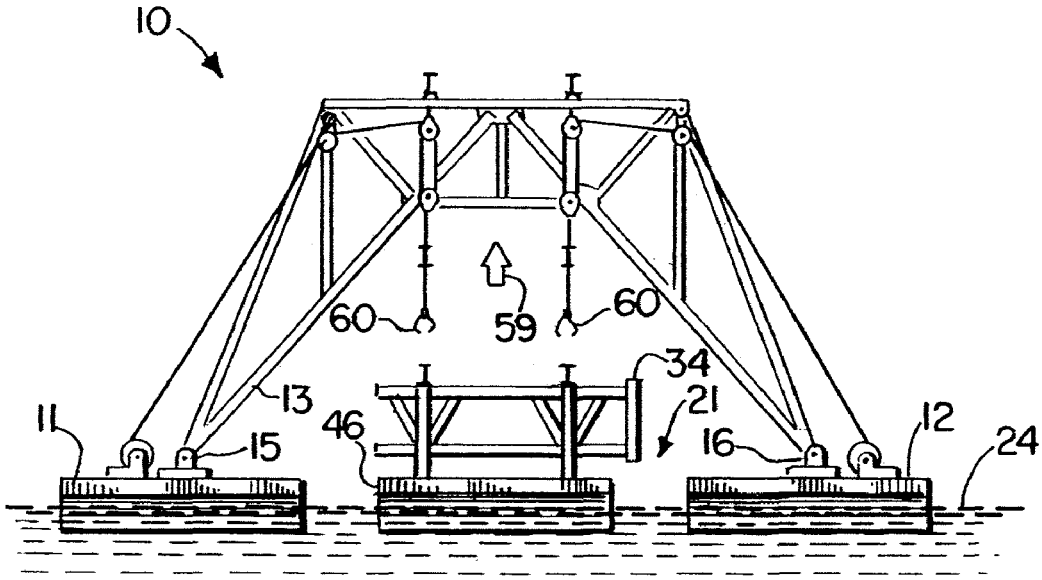
Figure 17:
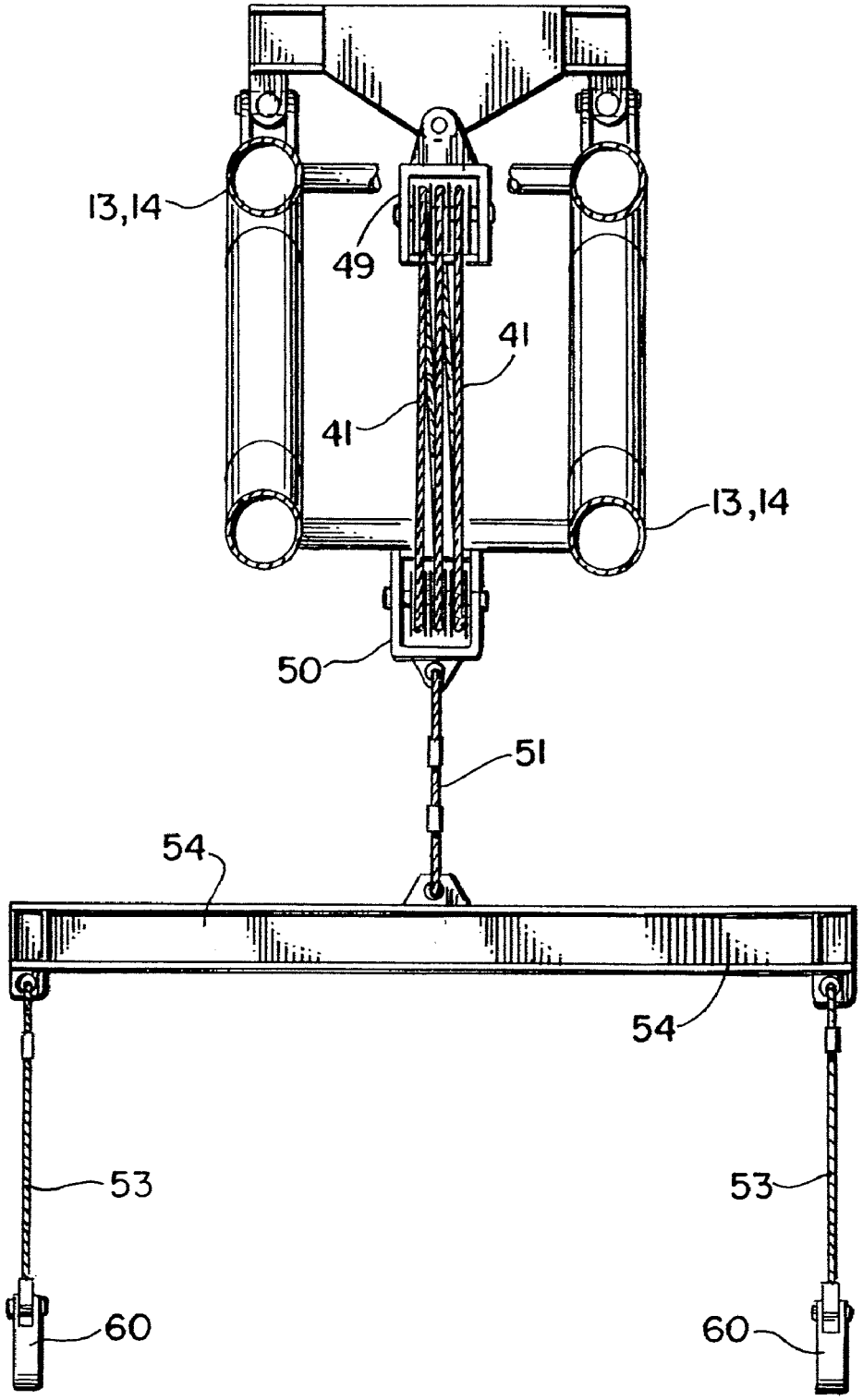
FIG. 17 is a sectional view taken along lines 17-17 of FIG. 10.

In FIGS. 10-17, each of the frames 13, 14 is rigged with an upper sheave 48 and upper pulley block 49. Each frame 13 or 14 can be rigged with a lifting line 41 and one or more winches 42. In FIGS. 10-12 for example, each frame 13, 14 has two winches 42, each winch 42 having a lifting line or cable 41. Lower pulley block 50 is positioned below upper pulley block 49. The pulley blocks 49, 50 can provide multiple pulleys such as is shown in FIGS. 10, 13 and 17. Slings 51 can be rigged to each lower pulley block 50. Each sling 51 can support a lifting beam or spreader bar 54. Each spreader bar 54 can support one or more slings 53 as shown in FIGS. 12, 17. The slings 53 can be provided with any selected additional rigging such as clamps, shackles or grabs 60, as examples. Arrows 47 in FIG. 12 show lines 41 being payed out to lower the lower pulley blocks 50 to damaged platform section 34 (see arrow 56, FIG. 12).

Figure 14:
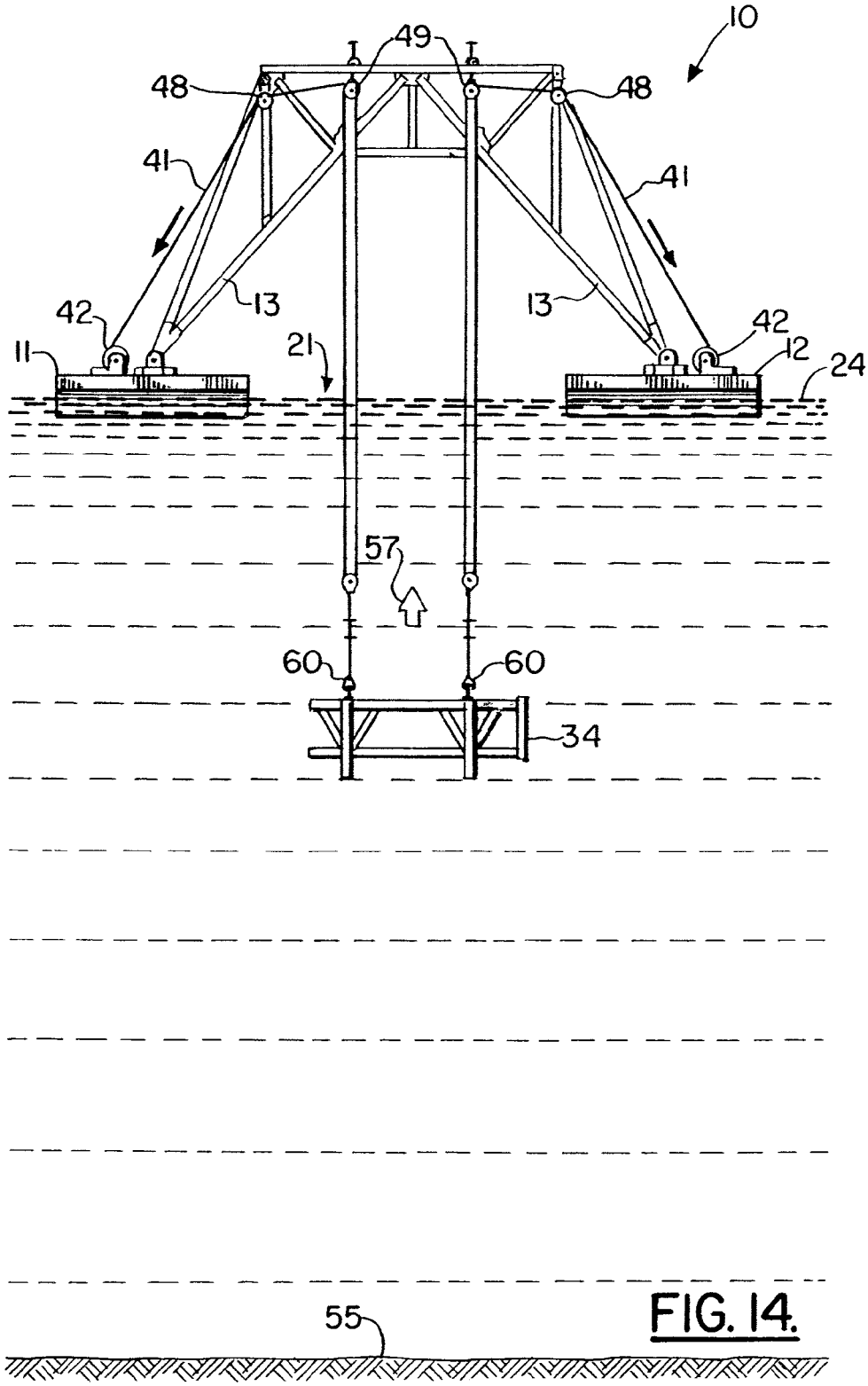
FIG. 14 is an elevation view of the preferred embodiment of the apparatus of the present invention and illustrating the method of the present invention.

The damaged platform section 34 to be salvaged can be fitted with beams 52 such as I-beams as an example. As the damaged or sunken platform section 34 rests upon seabed 55, grabs 60 can be attached to the beams 52 with slings 53 as shown in FIG. 12 for a lifting operation. Arrow 56 in FIG. 12 schematically illustrates a lowering of the lower pulley blocks 50 to the sunken, damaged platform section 34. After the grabs 60 are connected to the beams 52, arrow 57 in FIG. 14 schematically illustrates an elevating of the platform section 34 as each line 41 is wound upon its winch 42.

In FIG. 15, the transport vessel 46 is moved into the area 21 under frames 13, 14. Arrow 58 schematically illustrates a lowering of the damaged platform section 34 to the vessel 46. In FIG. 16, grabs 60 have been released from beams 52 and lifted upwardly in the direction of arrow 59, away from the damaged platform section 34. The damaged or salvaged item such as a vessel 33 or damaged platform section 34 can then be transported to a selected locale using the transport vessel or transport barge 46.

In FIG. 11, an alternate load spreader platform construction is shown. A smaller load spreader platform 36 is placed under each universal joint 15 or 17 of the frame 13 or 14. A larger load spreader platform 37 is placed under each pinned connection or hinge 16 or 18 of the frame 13 or 14. Each platform 36, 37 can comprise a plurality of longitudinal beams 38 and a plurality of transverse beams as shown. The beams 38, 39 can be structurally connected together (e.g. welded together).

Figure 18:
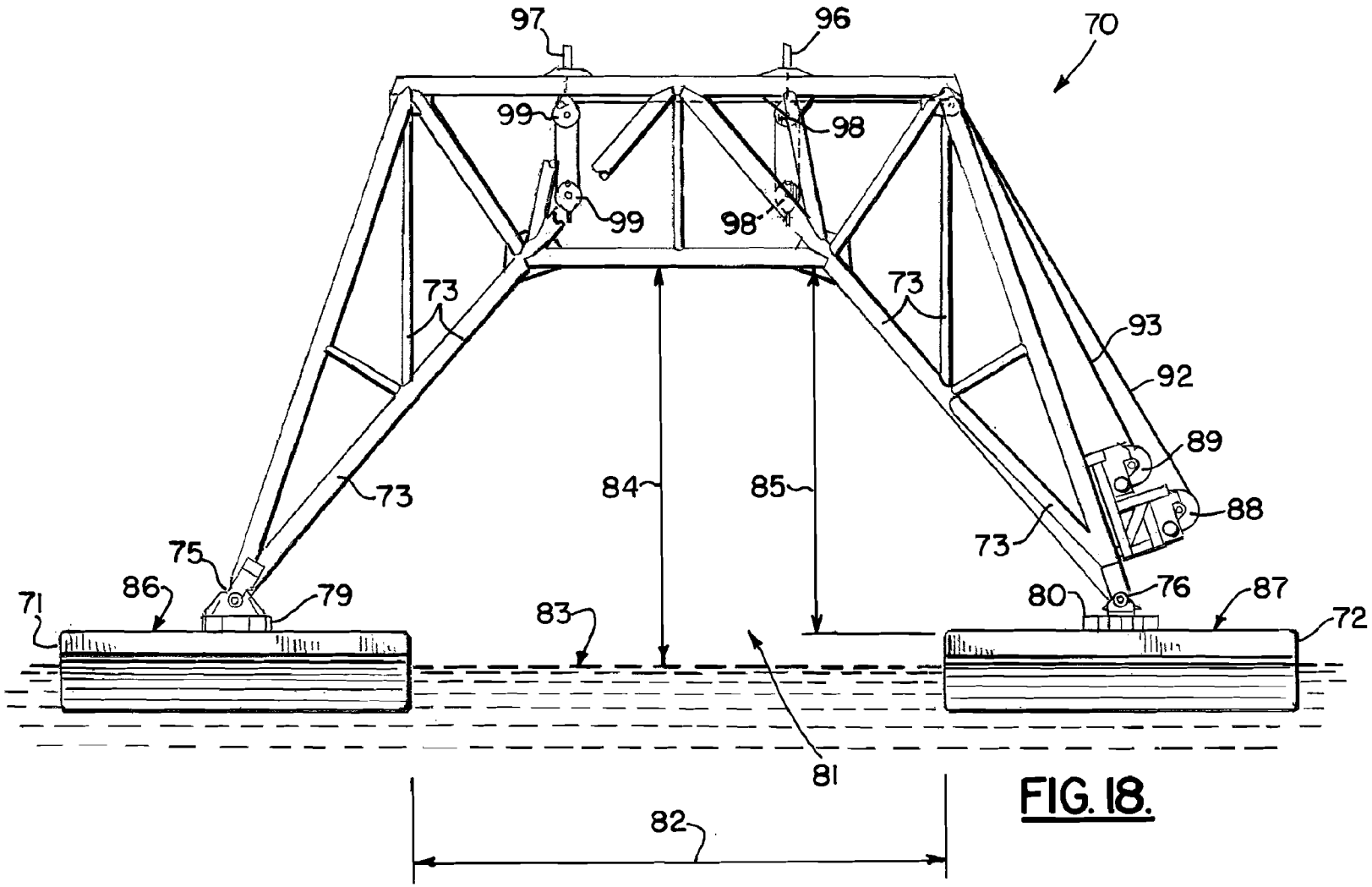
FIG. 18 is an elevation view of a second embodiment of the apparatus of the present invention.
Figure 19:
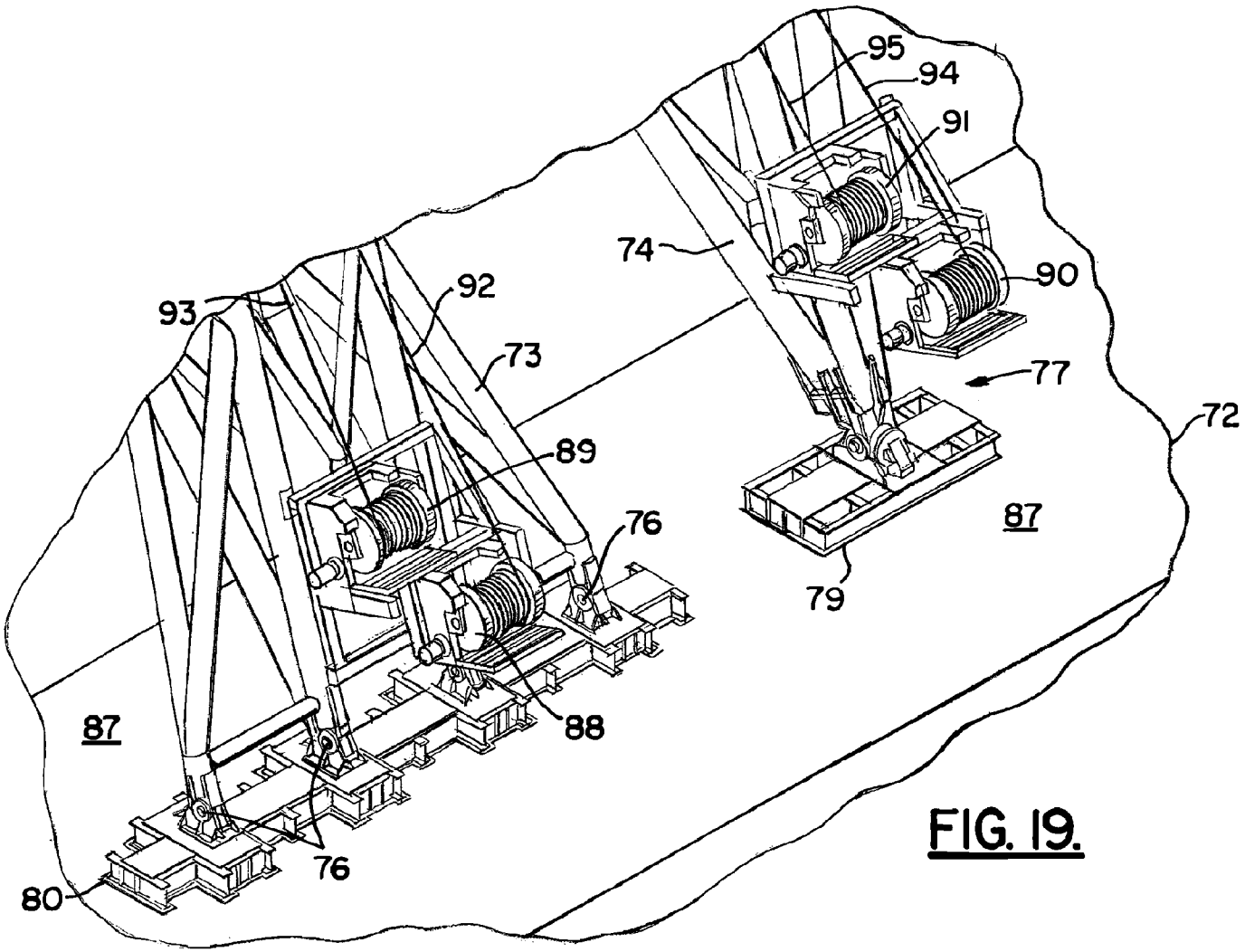
FIG. 19 is a fragmentary view of the second embodiment of the apparatus of the present invention.

FIGS. 18-25 show a second embodiment of the apparatus of the present invention designated generally by the numeral 70. As with the preferred embodiment of FIGS. 1-17, the second embodiment of FIGS. 18-25 provides a marine lifting apparatus 70 that employs two vessels or hulls 71, 72. The vessels or hulls 71, 72 support a pair of frames 73, 74. Each frame 73, 74 is attached to each of the vessels 71, 72 using a universal joint and a hinge. The frame 73 attaches to the vessel 71 using universal joint 75 and to vessel 72 using hinge 76. Similarly, the frame 74 attaches to vessels 71 using hinge and to vessel 72 using universal joint 77. The universal joint 75 of the frame 73 and the universal joint 77 of the frame 74 are on different vessels as shown. Each of the frames 73, 74 interfaces with the vessels 71, 72 via universal joints and hinges and optionally with a load spreader platform interface 79, 80. FIG. 19 shows more particularly a load spreader platform interface 79, 80 and a universal joint 75, 77.

An area 81 is provided in between each of the vessels 71, 72 as shown in FIG. 18 and under each of the frames 73, 74. In FIG. 18, dimension line 84 indicates the clearance between water surface 83 and each frame 73 or 74. The dimension line 85 indicates the clearance above the hull deck 86 or 87 of vessel 71 or 72 as shown. The dimension line 82 can be the width of the area 81 in between the barges or vessels 71, 72, indicated by the dimension line in FIG. 18 that is labeled with reference numeral 82.

A plurality of winches 88-91 are provided, 2 winches 88-89 or 90, 91 for each frame 73, 74. Each of the winches 88-91 provides a winch line that enables the winch to lift objects from a seabed or from the water surface area 83 via a crown block or block and tackle arrangement as shown in the drawings. The winch 88 provides a winch line 92. The winch 89 provides a winch line 93. The winches 88, 89 are mounted upon frame 73 as shown in FIG. 19. The winches 90, 91 are mounted upon the frame 74 as shown in FIG. 19. Winch 90 provides winch line 94. Winch 91 provides winch line 95.

Each frame 73, 74 is preferably in the form of a truss. In FIG. 18, each frame 73, 74 provides a pair of spaced apart beams 96, 97 that are used to support a crown block 98 or 99 or other lifting arrangement such a block or tackle or the like.

In the embodiment of FIGS. 18-25, there is provided for example two winches 88, 89 or 90, 91 for each frame 73 or 74.

Each winch 88-91 is rigged to one of the beams 96, using sheaves or other rigging. Each beam 96, 97 supports a crown block 98, 99, block and tackle or other lifting arrangement that affords mechanical advantage when the winches 88-91 are wound in a selected direction for either paying out or reeling in the respective winch lines 92-95.

Figure 20:
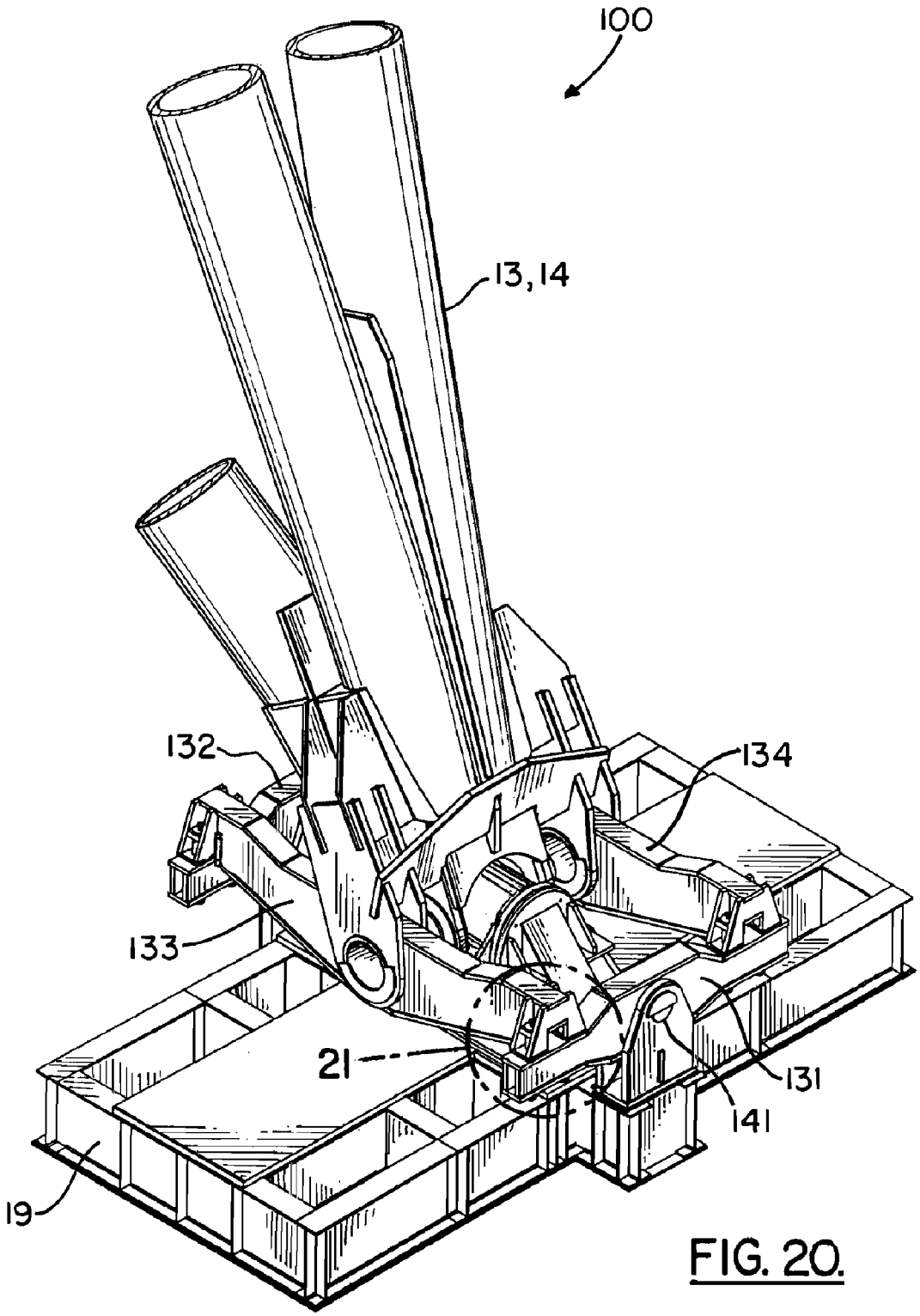
FIG. 20 is a partial perspective view of the preferred embodiment of the apparatus of the present invention showing an alternate universal joint arrangement.
Figure 21:
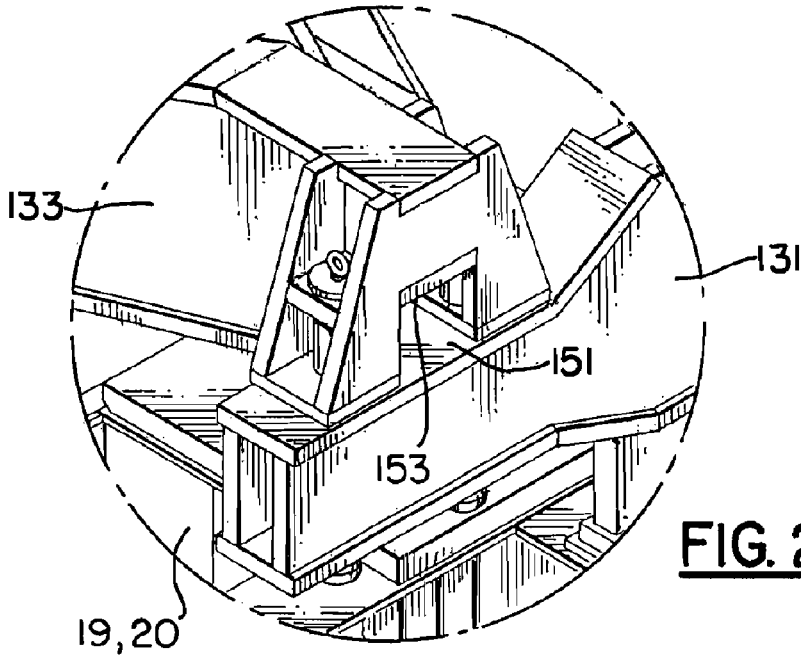
FIG. 21 is an enlarged fragmentary view of the preferred embodiment of the apparatus of the present invention showing the alternate universal joint.
Figure 22:
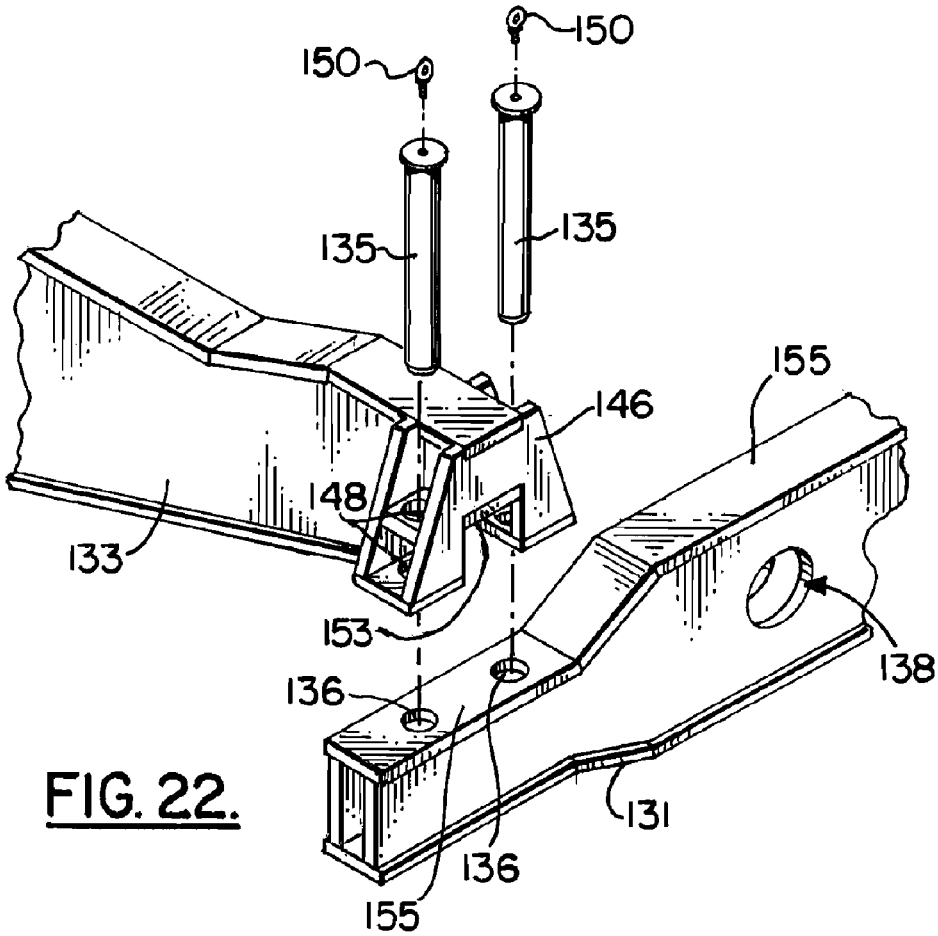
FIG. 22 is a partial exploded view of the preferred embodiment of the apparatus of the present invention showing the alternate universal joint.
Figure 23:
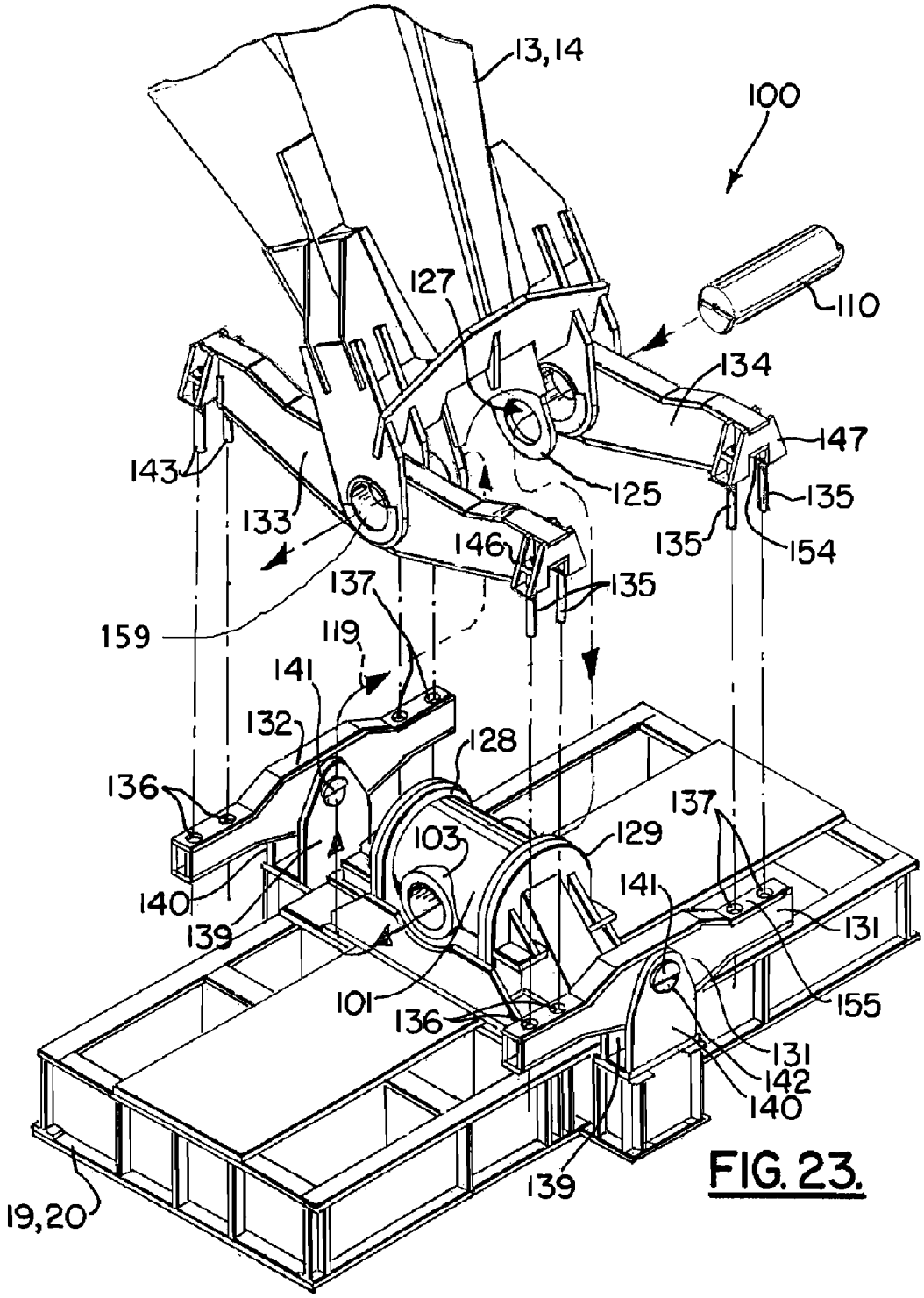
FIG. 23 is a partial perspective exploded view of the preferred embodiment of the apparatus of the present invention showing the alternate universal joint.
Figure 24:
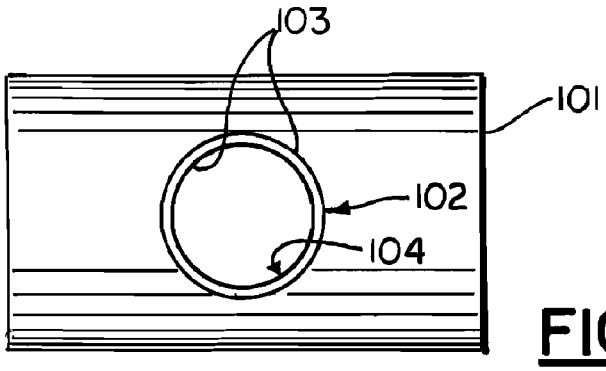
FIG. 24 is a fragmentary view of the preferred embodiment of the apparatus of the present invention showing a part of the alternate universal joint.

FIGS. 20-34 show an alternate universal joint, designated by the numeral 100 in FIGS. 20 and 23. The alternate universal joint 100 of FIGS. 20-34 is a redundant or double universal joint 100. This universal joint 100 enables an inner universal joint to be replaced or serviced while an outer universal joint carries the articulating load from a frame 13 or 14. It should be understood, that the universal joint 100 of FIGS. 20-34 could be used in place of either of the universal joints 15 or 17 of the embodiments of FIGS. 1-19.

Double universal joint 100 provides a larger pin 101 supported by a pair of pin supports 128, 129 as shown on FIG. 23. Larger pin 101 is rotatably mounted to each of the pin supports 128, 129. Rotation of the pin 101 enables rotation of pin 101 about axis 130.

Figure 30:
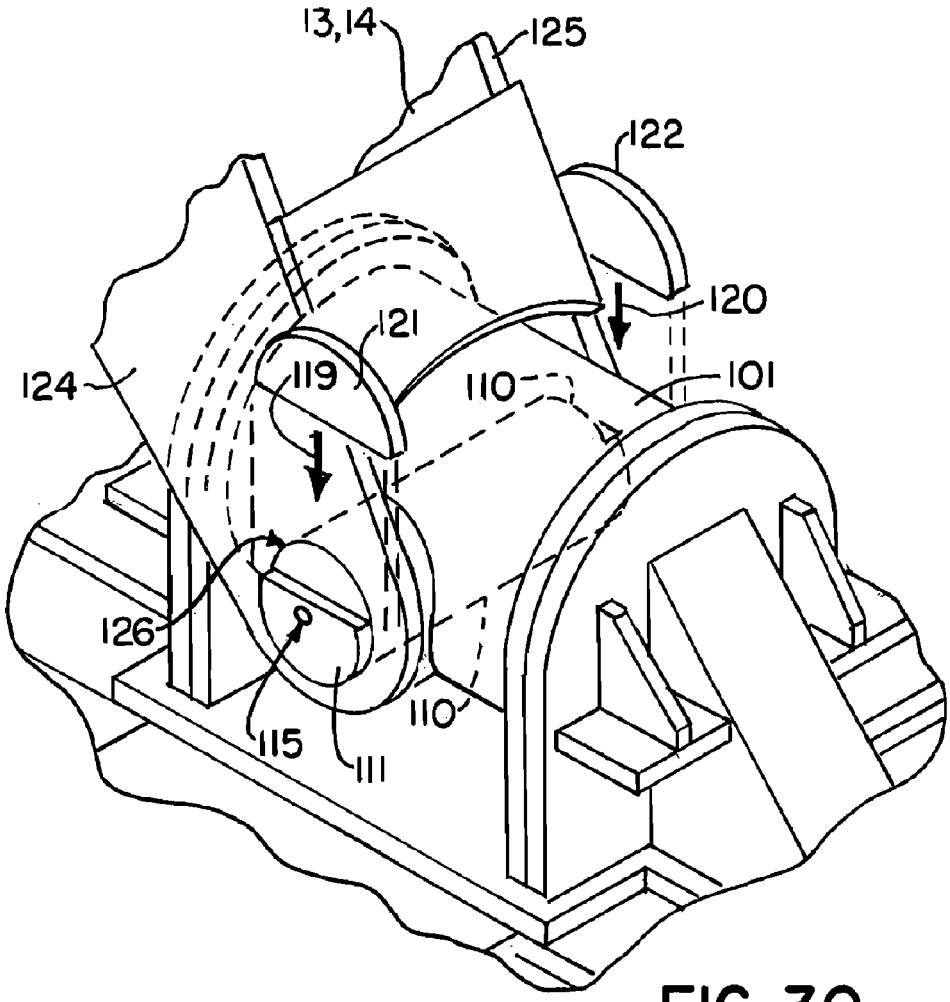
FIG. 30 is a partial perspective view of the preferred embodiment of the apparatus of the present invention showing the alternate universal joint.
Figure 31:
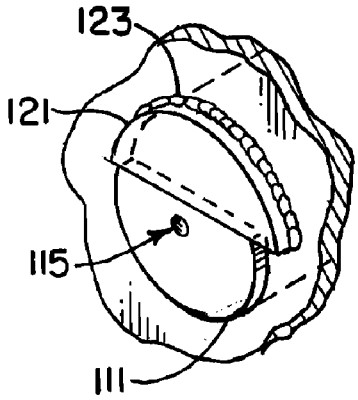
FIG. 31 is a partial perspective view of the preferred embodiment of the apparatus of the present invention showing the alternate universal joint.
Figure 32:
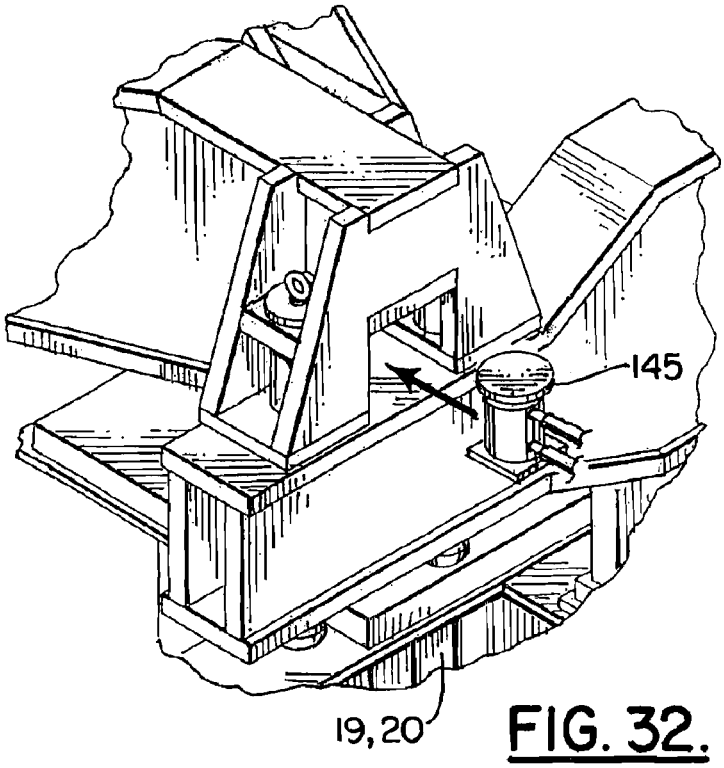
FIG. 32 is a partial perspective view of the preferred embodiment of the apparatus of the present invention showing the alternate universal joint.
Figure 33:
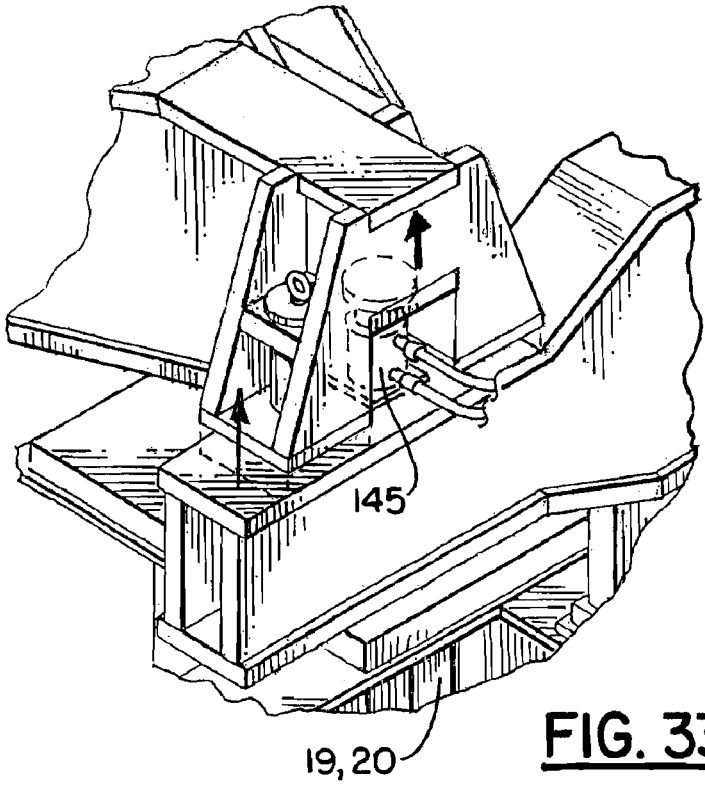
FIG. 33 is a partial perspective view of the preferred embodiment of the apparatus of the present invention showing the alternate universal joint.

Larger pin 101 (FIGS. 24-26) provides an opening 102 that is fitted with pipe sleeve 103. Pipe sleeve 103 has inner surface 104 that is receptive of bearing 105. The bearing 105 has a wall 106 that surrounds an inner generally cylindrically shaped open-ended bore 107. Outer surface 108 of bearing 105 engages inner surface 104 of pipe sleeve 103 as shown in FIGS. 26 and 30. Bore 107 provides central longitudinal axis 109. The axis 109 is also the central longitudinal axis of smaller pin 110 which fits into bore 107 as shown in FIG. 30.

Figure 27:
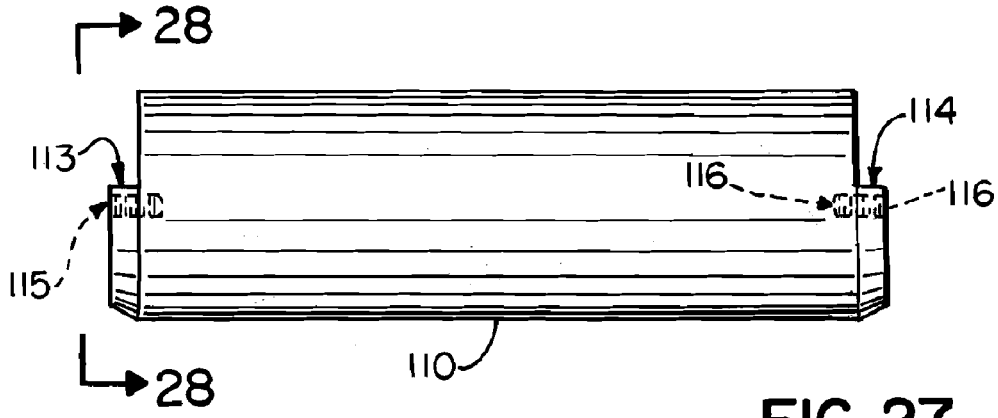
FIG. 27 is a fragmentary view of the preferred embodiment of the apparatus of the present invention showing a part of the alternate universal joint.
Figure 28:
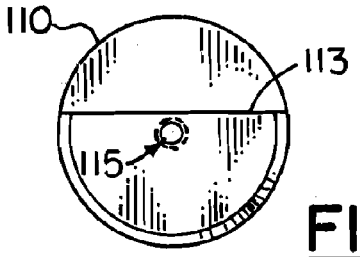
FIG. 28 is an end view taken along lines 28-28 of FIG. 27.
Figure 29:
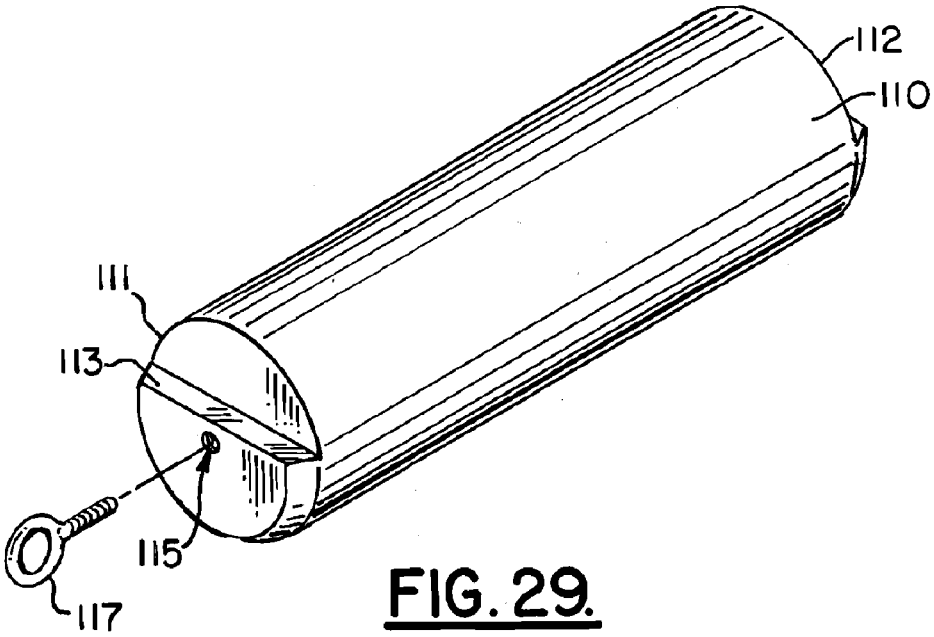
FIG. 29 is a partial perspective view of the preferred embodiment of the apparatus of the present invention showing a part of the alternate universal joint.
Figure 34:
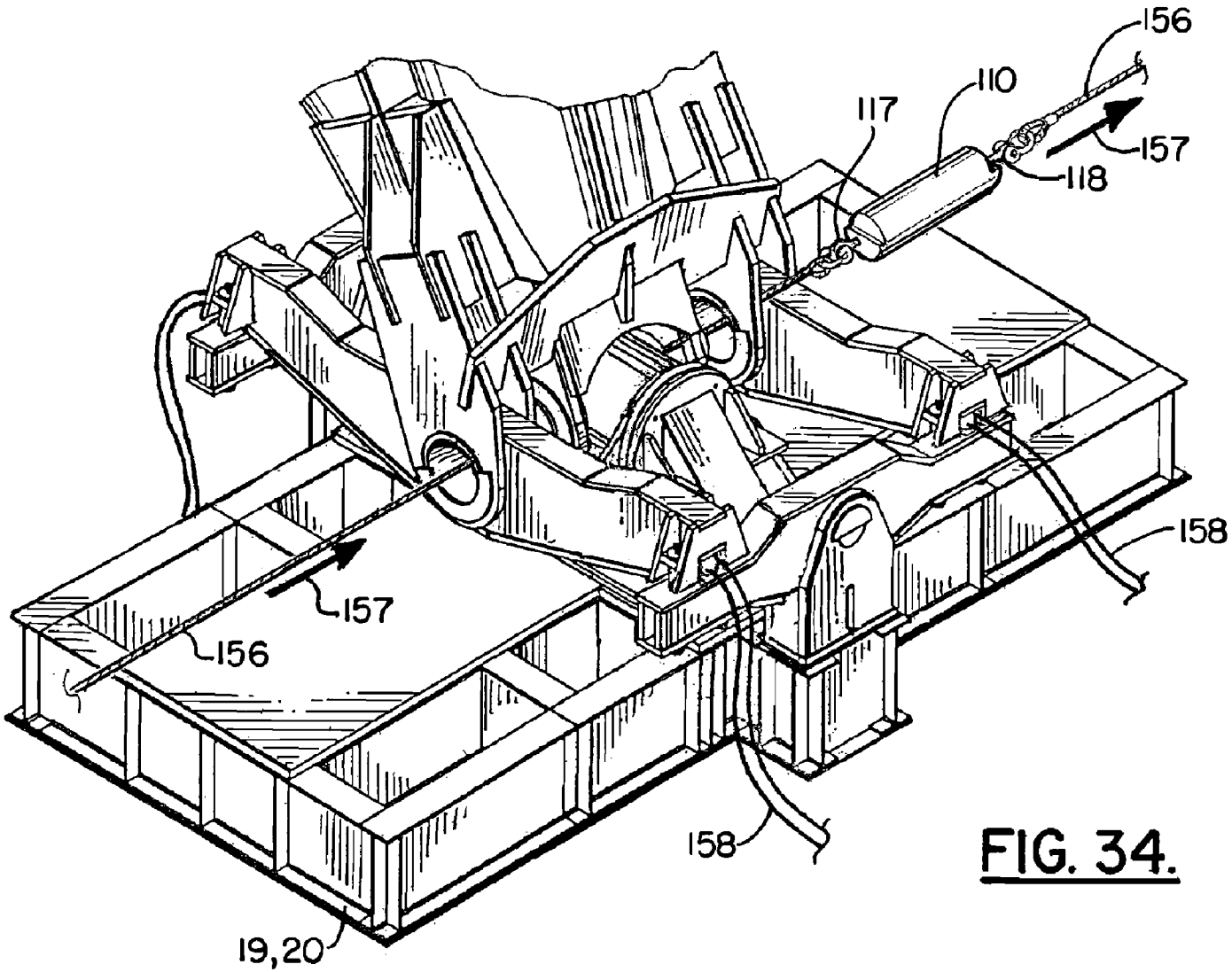
FIG. 34 is a partial perspective view of the preferred embodiment of the apparatus of the present invention showing the alternate universal joint and illustrating pin removal.

Smaller pin 110 has end portions 111, 112. These end portions 111, 112 protrude from bearing 105 when pin 110 occupies bore 107. Smaller pin 110 has flat surfaces at 113, 114 next to end portions 111, 112 as shown in FIGS. 27-29. Each end portion 111, 112 of smaller pin 110 provides an internally threaded opening 115, 116. The internally threaded openings 115, 116 can be used to attach an eye bolt 117 or 118 to smaller pin 110 by threading the eye bolt 117 or 118 into an internally threaded opening 115 or 116. The eye bolts 117, 118 can be used to remove the pin 110 for servicing as shown in FIG. 34.

After assembling smaller pin 110 into the bore 107 of bearing 105, plates 121, 122 are then welded to pin 110 at flat surfaces 113, 114 respectively. The placement of the plates 121, 122 on the end portions 111, 112 of pin 110 are illustrated by arrows 119, 120 in FIG. 30. A weld 123 is used to attach each plate 121 or 122 to an end portion 111 or 112 of pin 110 after bearing 105 has been placed into pipe sleeve 103 and pin 110 placed into open-ended bore 107 of bearing 105. The end portions 111, 112 of pin 110 extend through openings 126, 127 of plate sections 124, 125 that are a part of a frame 13 or 14 as shown in FIGS. 23 and 30. In order to remove the smaller pin 110 for servicing of pin 110 or bearing 105, the plates 121, 122 must be first removed by breaking the weld 123 that holds a plate 121 or 122 to pin 110.

Pin 110 and bearing 105 can be removed for servicing by using the second or redundant part of double universal joint 100. The second part or redundant part of double universal joint 100 is provided by front and rear beams 131, 132 and left and right side beams 133, 134. Each left and right side beam 133, 134 connects to a front beam 131 and a rear beam 132 using pins 135 as illustrated in FIG. 22.

Figure 25:
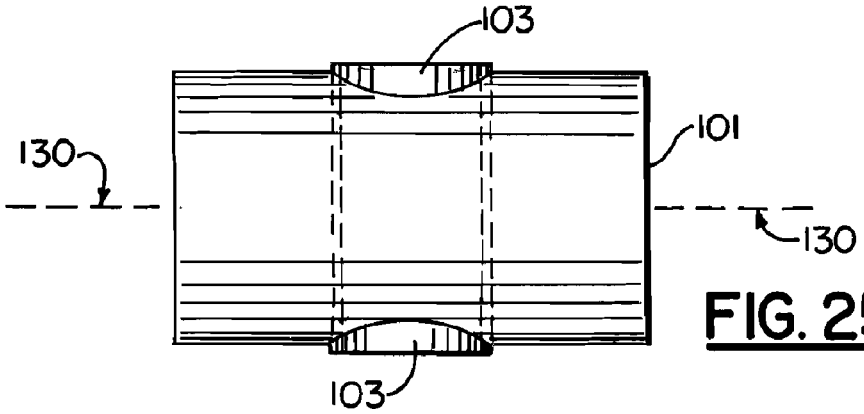
FIG. 25 is a fragmentary view of the preferred embodiment of the apparatus of the present invention showing a part of the alternate universal joint.
Figure 26:
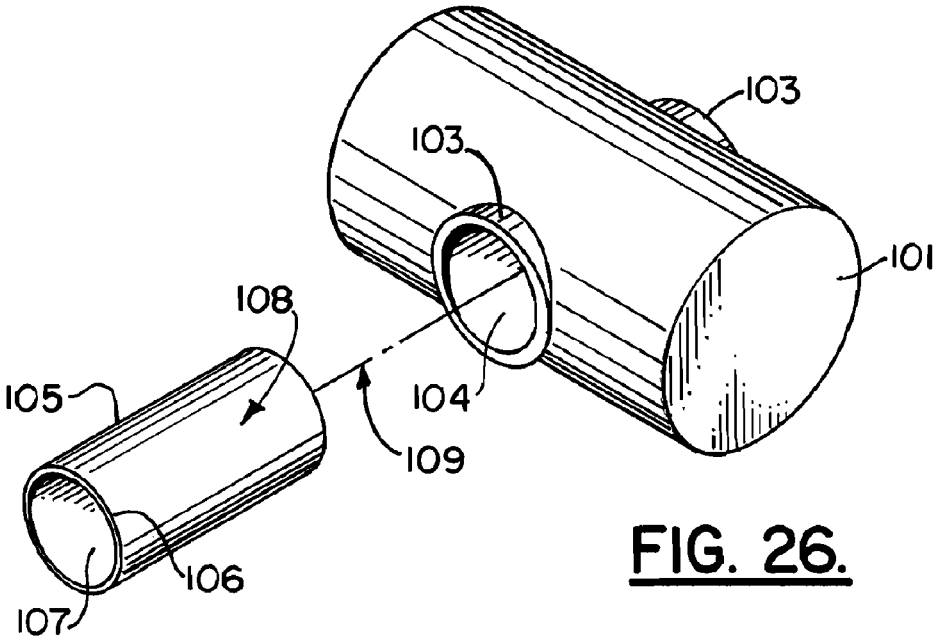
FIG. 26 is a partial exploded perspective view of the preferred embodiment of the apparatus of the present invention showing a part of the alternate universal joint.

The inner universal joint has two axes of rotation 109 (FIG. 26), 130 (FIG. 25). One skilled in the art will recognize that the outer universal joint (including beams 131, 132, 133, 134) will also have two axes of rotation (as does any universal joint). In order for the inner and outer universal joints to function, the axes 109, 131 of one of the universal joints must necessarily be the axes 109, 131 of the other universal joint. Otherwise, the inner and outer universal joints could not function without binding.

Each of the front and rear beams 131, 132 provides a pair of openings 136 that are receptive of pins 135 when connecting to the left side beam 133 and a pair of openings 137 for connecting the right side beam 134 to front beam 131. Each front beam 131 and rear beam 132 provide a central opening 138 (see FIG. 22) that forms a pivoting connection with a load spreader platform 19 or 20 at support plates 139, 140 (see FIG. 23). A pin 141 can be placed through openings 142 in plates 139, 140 for perfecting a pinned or pivotal connection between the front beam 131 and load spreader platform 19 or 20 at plates 139, 140. Rear beam 132 connects to load spreader platform 19, 20 at plates 139, 140 using a pin 141 to form a pinned or pivotal connection. The rear beam 132 likewise provides openings at 136, 137 that are receptive of pins 143 for attaching left side beam 133 to rear beam 132 at openings 136. A connection can be formed between right side beam 134 and rear beam 132 at openings 137 using pins 143.

The inner or first universal joint of double universal joint 100 is defined by larger pin 101 and smaller pin 110 which is rotatably attached to a frame 13 or 14. The smaller pin 110 can be rotatably supported as can bearing 105 by supports 128, 129 by slightly elevating either the left side beam 133 or the right side beam 134 or both of the side beams 133, 134 using pancake jacks 145. Such pancake jacks 145 are commercially available. The pancake jacks 145 are quite powerful for lifting many tons of weight upwardly a short distance such as, for example, up to a few inches (e.g. 0-4 inches).

Each of the left and right side beams 133, 134 provides a connector 146 or 147 that is receptive of pins 135 when joining the left side beam 133 or right side beam 134 to the front beam 131. These beam connectors 146, 147 thus provide pin receptive openings at 148, 149 (see FIG. 22). When assembling the left side beam 133 to the front beam 131 in FIG. 22, each pin 135 extends through openings 148 on connector 146 and then to openings 136 on front beam 131. Each of the pins 135 can provide an eyebolt or eyelet 150 that enables a pin 135 to be engaged and lifted using a tool, rope, lift line or the like.

Each beam connector 146, 147 provides a cavity at 151 or 152 that is receptive of a pancake jack 145. A horizontal plate at 153, 154 is engaged by the upper end portion of a pancake jack 145 expands upwardly. The pancake jack 145 rests upon the upper surface 155 of front beam 131 in a position in between openings 136 or 137.

In order to remove pin 110 or bearing 105, a pancake jack 145 is placed in one of the cavities 151, 152. The pancake jack is extended a short distance such as for example about one inch or 1-2 inches. This action transfers load between load spreader platform 19 or 20 and a frame 13 or 14 to the outer or second universal joint defined by the beams 131, 132, 133, 134 and relieves pressure on the pins 100, 110. The pin 110 can be removed using a cable 156 which can be attached to either one of the eyelets or eyebolts 117, 118 that are attached to pin 110 as shown in FIG. 34. Arrows 157 illustrate removal of the pin 110 by pulling rope or cable 156 in the direction or arrows 157. The cable 156 extends fully across the platform 19 or 20 so that a new pin 110 and/or bearing 105 can be replaced by pulling the cable 156 in the opposite direction of that shown in FIG. 34.

Any suitable known connector can join a frame 13 or 14 to the beams 133, 134 to provide this carriage of the articulating load, such as for example a cylindrical bearing at 159 (FIG. 23) with a central opening for enabling removal of pin 110 (FIGS. 23, 27-30) through the central opening.

The following is a list of parts and materials suitable for use in the present invention.

PARTS LIST

| Part Number | Description |
|---|---|
| 10 | marine lifting apparatus |
| 11 | vessel |
| 12 | vessel |
| 13 | first frame or truss |
| 14 | second frame or truss |
| 15 | universal joint |
| 16 | hinge |
| 17 | universal joint |
| 18 | hinge |
| 19 | load spreader platform interface |
| 20 | load spreader platform interface |
| 21 | area |
| 22 | dimension line |
| 23 | dimension line |
| 24 | water surface |
| 25 | clearance above water |
| 26 | clearance above hull deck |
| 27 | center truss section |
| 28 | smaller truss section |
| 29 | smaller truss section |
| 30 | hull deck |
| 31 | pinned connection |
| 32 | pinned connection |
| 33 | sunken vessel |
| 34 | damaged platform section |
| 35 | maximum deck elevation |
| 36 | load spreader platform |
| 37 | load spreader platform |
| 38 | longitudinal beam |
| 39 | transverse beam |
| 40 | lifting hook |
| 41 | lifting line |
| 42 | winch |
| 43 | sheave |
| 44 | sheave |
| 45 | sheave |
| 46 | transport vessel |
| 47 | arrow |
| 48 | upper sheave |
| 49 | upper pulley block |
| 50 | lower pulley block |
| 51 | sling |
| 52 | beam |
| 53 | sling |
| 54 | spreader bar |
| 55 | seabed |
| 56 | arrow |
| 57 | arrow |
| 58 | arrow |
| 59 | arrow |
| 60 | grab |
| 61 | padeye |
| 62 | padeye |
| 63 | first shaft |
| 64 | second shaft |
| 65 | arrow |
| 66 | arrow |
| 67 | anchor line |
| 68 | anchor winch |
| 69 | opening |
| 70 | marine lifting apparatus |
| 71 | vessel |
| 72 | vessel |
| 73 | frame |
| 74 | frame |
| 75 | universal joint |
| 76 | hinge |
| 77 | universal joint |
| 78 | hinge |
| 79 | load spreader platform interface |
| 80 | load spreader platform interface |
| 81 | area |

-continued

PARTS LIST

| Part Number | Description |
|---|---|
| 82 | dimension line |
| 83 | water surface area |
| 84 | clearance above water |
| 85 | clearance above hull deck |
| 86 | hull deck |
| 87 | hull deck |
| 88 | winch |
| 89 | winch |
| 90 | winch |
| 91 | winch |
| 92 | winch line |
| 93 | winch line |
| 94 | winch line |
| 95 | winch line |
| 96 | beam |
| 97 | beam |
| 98 | crown block |
| 99 | crown block |
| 100 | double universal joint |
| 101 | larger pin |
| 102 | opening |
| 103 | pipe sleeve |
| 104 | inner surface |
| 105 | bearing |
| 106 | wall |
| 107 | bore |
| 108 | outer surface |
| 109 | axis |
| 110 | smaller pin |
| 111 | end portion |
| 112 | end portion |
| 113 | surface |
| 114 | surface |
| 115 | internally threaded opening |
| 116 | internally threaded opening |
| 117 | eyebolt |
| 118 | eyebolt |
| 119 | arrow |
| 120 | arrow |
| 121 | plate |
| 122 | plate |
| 123 | weld |
| 124 | plate section |
| 125 | plate section |
| 126 | opening |
| 127 | opening |
| 128 | pin support |
| 129 | pin support |
| 130 | pin axis |
| 131 | front beam |
| 132 | rear beam |
| 133 | left side beam |
| 134 | right side beam |
| 135 | pin |
| 136 | opening |
| 137 | opening |
| 138 | opening |
| 139 | plate |
| 140 | plate |
| 141 | pin |
| 142 | opening |
| 143 | pins |
| 145 | pancake jack |
| 146 | beam connector |
| 147 | beam connector |
| 148 | opening |
| 149 | opening |
| 150 | eyebolt/eyelet |
| 151 | cavity |
| 152 | cavity |
| 153 | horizontal plate |
| 154 | horizontal plate |
| 155 | upper surface |
| 156 | cable/rope |
| 157 | arrow |

-continued

| PARTS LIST | |
|---|---|
| Part Number | Description |
| 158 | hydraulic fluid lines |
| 159 | cylindrical bearing |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of lifting a multi-ton object in a marine environment comprising the steps of:

a) providing first and second vessels at a locale that is next to an object to be salvaged;

b) mounting a first frame on the vessels that spans between the vessels;

c) mounting a second frame on the vessels that spans between the vessels;

d) connecting the frames to the vessels in a configuration that spaces the vessels apart;

e) connecting the first frame to the first vessel with a universal joint and to the second vessel with a hinged connection;

f) connecting the second frame to the second vessel with a universal joint, and to the first vessel with a hinged connection;

g) providing a space under the frame and in between the vessels, enabling a third marine vessel to be positioned in between the vessels and under the frames;

h) lifting the object with cabling that extends downwardly from the frames; and i) wherein at least one of the universal joints is comprised of a first, inner universal joint and a second, outer universal joint.

2. The method of claim 1 wherein in steps "e" and "f", both of the universal joints include an inner and an outer universal joint.

3. The method of claim 1 further comprising the step of connecting rigging between each frame and the object, said rigging including slings and hooks.

4. The method of claim 1 further comprising the step of connecting rigging between each frame and the object, said rigging including slings and hooks.

5. The method of claim 1 wherein the underwater object is a platform structure having a deck and beams under the deck and further comprising extending rigging through the deck via one or more deck openings and connecting the rigging to beams under the deck.

6. The method of claim 1 wherein the rigging extends between the object and the upper end portion of the frames.

7. The method of claim 1 further comprising mounting a winch and winch cabling on the combination of vessels and frames and further comprising lifting the object to be salvaged with the winch and winch cabling.

8. The method of claim 1 further comprising attaching rigging that includes a hook suspended from the winch cabling and one or more slings attached to the object and to the hook.

9. The method of claim 1 further comprising the step of rigging more than one lifting line to a frame.

10. The method of claim 1 wherein in step "h" the cabling includes multiple winds of cabling rigged to a block and tackle pulley arrangement.

11. The method of claim 1 further comprising the step of spanning one or more beams between the frames and in step "h" the cabling depends from the beams.

12. A method of salvaging an underwater object from a seabed area comprising the steps of:

a) providing first and second spaced apart hulls;

b) spanning between the hulls with a first arch;

c) spanning between the hulls with a second arch;

d) spacing the arches apart by connecting the hulls together in a configuration that spaces the hulls apart;

e) connecting the first arch to the first hull with a joint that includes an inner universal joint and an outer universal joint;

f) connecting the second arch to the second hull with a hinged connection;

g) connecting the second arch to the second hull with a joint that includes an inner universal joint and an outer universal joint;

h) connecting the first arch to the first hull with a hinged connection;

i) extending each arch upwardly in an inverted u-shape, providing a space under the arches and in between the hulls; and j) lifting the underwater object from the seabed area with rigging fitted to the arches.

13. The method of claim 12 wherein each arch supports one or more beams and in step "j" the rigging includes the beams.

14. The method of claim 12 wherein the rigging includes a pair of beams.

15. The method of claim 12 wherein the first arch is a truss.

16. The method of claim 12 wherein the second arch is a truss.

17. The method of claim 12 wherein the underwater object is a platform having a deck and further comprising one or more slings that connect between the rigging and the platform.

18. The method of claim 17 further comprising the step of providing a hook as part of the rigging.

19. The method of claim 18 wherein the sling spans between the hook and the platform and the sling extending through the deck.

20. The method of claim 12 wherein the first arch is much wider at one end portion than at its other end portion.

21. The method of claim 12 wherein the second arch is much wider at one end portion than at its other end portion.

22. A method of lifting an object in a marine environment, comprising the steps of:

a) providing a pair of floating hulls;

b) spanning between the hulls with a first frame;

c) spanning between the hulls with a second frame;

d) wherein in steps "b" and "c", the frames are spaced apart and connected to the hulls in a configuration that spaces the hulls apart;

e) connecting the first frame to the first hull with a universal joint and to the second hull with a hinged connection;

f) connecting the second frame to the second hull with a universal joint, and to the first hull with a hinged connection;

g) extending each frame upwardly and providing a space under the frame and in between the hulls;

h) lifting the object with rigging attached at least in part to the frames; and i) wherein each universal joint includes first and second universal joints.

23. The method of claim 22 wherein each frame supports one or more beams that are a part of the rigging of step "h".

24. The method of claim 22 wherein the rigging includes one or more beams that are connected to the frames.

25. The method of claim 22 wherein the first frame is a truss.

26. The method of claim 22 wherein the second frame is a truss.

27. The method of claim 22 further comprising the step of supporting one or more beams with the frames and in step "j" the rigging is fitted to the beams.

28. The method of claim 27 further comprising suspending a crown block from the beams as part of the rigging.

29. The method of claim 27 further comprising suspending a hook from the beams as part of the rigging.

30. The method of claim 22 wherein the first frame is much wider at one end portion than at its other end portion.

31. The method of claim 22 wherein the second frame is much wider at one end portion than at its other end portion.

32. The method of claim 22 wherein each frame has end portions, one end portion being wider than the other at a position where the frame end portions connect to a hull.

33. The method of claim 22 wherein each frame is generally arch shaped.

* * * * *